US009774979B1

(12) United States Patent
Morishita et al.

(10) Patent No.: US 9,774,979 B1
(45) Date of Patent: Sep. 26, 2017

(54) SYSTEMS AND METHODS FOR SPATIAL AUDIO ADJUSTMENT

(71) Applicant: Google Inc., Mountain View, CA (US)

(72) Inventors: Michael Kai Morishita, Belmont, CA (US); Chad Seguin, San Jose, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 15/059,949

(22) Filed: Mar. 3, 2016

(51) Int. Cl.
*H04R 25/00* (2006.01)
*H04S 7/00* (2006.01)
*H04R 5/033* (2006.01)

(52) U.S. Cl.
CPC ..... *H04S 7/304* (2013.01); *H04R 5/033* (2013.01); *H04R 2460/13* (2013.01); *H04S 2400/11* (2013.01); *H04S 2400/13* (2013.01); *H04S 2420/01* (2013.01)

(58) Field of Classification Search
CPC H04R 1/1008; H04R 1/1091; H04R 2420/01; H04R 2420/07; H04R 2460/03; H04R 29/00; H04R 5/04; G10L 19/018; H04H 20/103; H04H 20/16; H04H 20/24; H04H 60/06; H04H 60/21; H04H 60/82
USPC ..... 381/1–4, 17–19, 87, 98, 310, 300, 303, 381/307, 311, 309; 700/94
See application file for complete search history.

(56) References Cited

U.S. PATENT DOCUMENTS 7,558,635 B1 * 7/2009 Thiel ..... G01C 21/3629 381/85
7,853,649 B2 12/2010 Lee et al.
8,989,417 B1 3/2015 Zhong et al.
9,215,412 B2 12/2015 Gottlieb
9,226,090 B1 * 12/2015 Norris ..... H04S 7/304
2003/0223604 A1 * 12/2003 Nakagawa ..... H04M 1/6066 381/311
2012/0266067 A1 10/2012 Armstrong et al.
2014/0226842 A1 8/2014 Shenoy et al.
2014/0270183 A1 9/2014 Luna
2014/0363003 A1 * 12/2014 Kupershmidt ..... H04R 29/00 381/58
2015/0055770 A1 2/2015 Spittle et al.

FOREIGN PATENT DOCUMENTS

WO 2007/143373 12/2007

OTHER PUBLICATIONS

Written Opinion, International Application No. PCT/US2017/020682, dated May 24, 2017.

* cited by examiner

*Primary Examiner* — Lun-See Lao
(74) *Attorney, Agent, or Firm* — McDonnell Boehnen Hulbert & Berghoff LLP

(57) ABSTRACT

The present disclosure relates to managing audio signals within a user's perceptible audio environment or soundstage. That is, a computing device may provide audio signals with a particular apparent source location within a user's soundstage. Initially, a first audio signal may be spatially processed so as to be perceivable in a first soundstage zone. In response to determining a high priority notification, the apparent source location of the first audio signal may be moved to a second soundstage zone and an audio signal associated with the notification may be spatially processed so as to be perceivable in the first soundstage zone. In response to determining user speech, the apparent source location of the first audio signal may be moved to a different soundstage zone.

14 Claims, 14 Drawing Sheets

SYSTEMS AND METHODS FOR SPATIAL AUDIO ADJUSTMENT

BACKGROUND

"Ducking" is a term used in audio track mixing in which a background track (e.g., a music track), is attenuated when another track, such as a voice track, is active. Ducking allows the voice track to dominate the background music and thereby remain intelligible over the music. In another typical ducking implementation, audio content featuring a foreign language (e.g., in a news program) may be ducked while the audio of a translation is played simultaneously over the top of it. In these situations, the ducking is performed manually, typically as a post-processing step.

Some applications of audio ducking also exist that may be implemented in realtime. For example, an emergency broadcast system may duck all audio content that is being played back over a given system, such as broadcast television or radio, in order for the emergency broadcast to be more clearly heard. As another example, the audio playback system(s) in a vehicle, such as an airplane, may be configured to automatically duck the playback of audio content in certain situations. For instance, when the pilot activates an intercom switch to communicate with the passengers on the airplane, all audio being played back via the airplane's audio systems may be ducked so that the captain's message may be heard.

In some audio output devices, such as smartphones and tablets, audio ducking may be initiated when notifications or other communications are delivered by the device. For instance, a smartphone that is playing back audio content via an audio source may duck the audio content playback when a phone call is incoming. This may allow the user to perceive the phone call without missing it.

Audio output devices may provide a user with audio signals via speakers and/or headphones. The audio signals may be provided so that they seem to originate from various source locations inside or around the user. For example, some audio output devices may move an apparent source location of audio signals around a user (front, back, left, right, above, below, etc.) as well as moved closer to and farther from the user.

SUMMARY

Systems and methods disclosed herein relate to the dynamic playback of audio signals from an apparent location or locations within a user's three-dimensional acoustic soundstage. For example, while a computing device is playing audio content such as music via headphones, the computing device may receive an incoming high-priority notification and in response, may spatially duck the music while the an audible notification signal is played out. The spatial ducking process may involve processing the audio signal for the music (and perhaps the audible notification signal as well), such that the listener perceives the music as originating from a different location than that which the audible notification signal originates from. For example, the audio may be spatially processed such that when the music and audible notification are played out in headphones, the music is perceived as originating behind the listener, while the audible notification signal is perceived as originating in front of the listener. This may improve the user's experience by making the notification more recognizable and/or by providing content to the user in a more context-dependent manner.

In an aspect, a computing device is provided. The computing device includes an audio output device, a processor, a non-transitory computer readable medium, and program instructions. The program instructions are stored on the non-transitory computer readable medium that, when executed by the processor, cause the computing device to perform operations. The operations include, while driving the audio output device with a first audio signal, receiving an indication to provide a notification with a second audio signal and determining the notification has a higher priority than playout of the first audio signal. The operations further include, in response to determining that the notification has the higher priority, spatially processing the second audio signal for perception in a first soundstage zone, spatially processing the first audio signal for perception in a second soundstage zone, and concurrently driving the audio output device with the spatially-processed first audio signal and the spatially-processed second audio signal, such that the first audio signal is perceivable in the second soundstage zone and the second audio signal is perceivable in the first soundstage zone.

In an aspect, a method is provided. The method includes driving an audio output device of a computing device with a first audio signal and receiving an indication to provide a notification with a second audio signal. The method also includes determining the notification has a higher priority than playout of the first audio signal. The method additionally includes, in response to determining that the notification has the higher priority, spatially processing the second audio signal for perception in a first soundstage zone, spatially processing the first audio signal for perception in a second soundstage zone, and concurrently driving the audio output device with the spatially-processed first audio signal and the spatially-processed second audio signal, such that the first audio signal is perceivable in the second soundstage zone and the second audio signal is perceivable in the first soundstage zone.

In an aspect, a method is provided. The method includes driving an audio output device of a computing device with a first audio signal and receiving, via at least one microphone, audio information. The method also includes determining user speech based on the received audio information. The method yet further includes, in response to determining user speech, spatially processing the first audio signal for perception in a soundstage zone and driving the audio output device with the spatially-processed first audio signal, such that the first audio signal is perceivable in the soundstage zone.

In an aspect, a system is provided. The system includes various means for carrying out the operations of the other respective aspects described herein.

These as well as other embodiments, aspects, advantages, and alternatives will become apparent to those of ordinary skill in the art by reading the following detailed description, with reference where appropriate to the accompanying drawings. Further, it should be understood that this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

Figure 1:
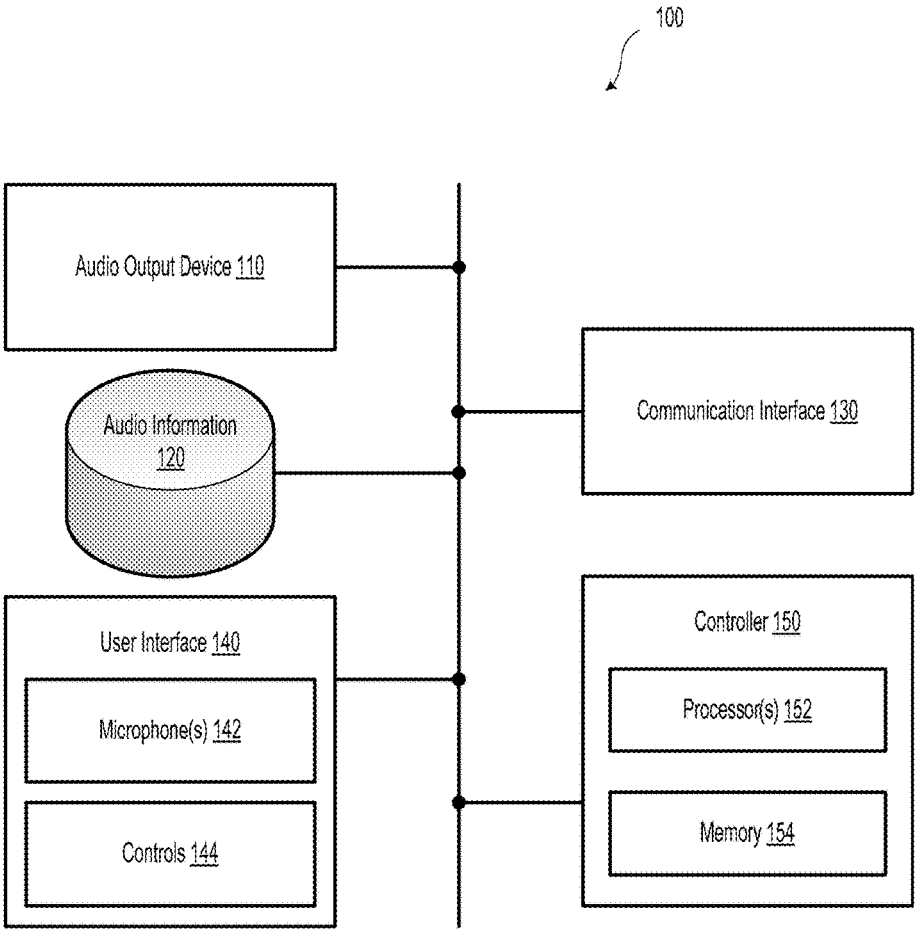
FIG. 1 illustrates a schematic diagram of a computing device, according to an example embodiment.

Example methods, devices, and systems are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. Other embodiments can be utilized, and other changes can be made, without departing from the scope of the subject matter presented herein.

Thus, the example embodiments described herein are not meant to be limiting. Aspects of the present disclosure, as generally described herein, and illustrated in the figures, can be arranged, substituted, combined, separated, and designed in a wide variety of different configurations, all of which are contemplated herein.

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

I. Overview

The present disclosure relates to managing audio signals within a user's perceptible audio environment or soundstage. That is, an audio output module can move an apparent source location of an audio signal around a user's acoustic soundstage. Specifically, in response to determining a high priority notification and/or user speech, the audio output module may "move" the first audio signal from a first acoustic soundstage zone to a second acoustic soundstage zone. In the case of a high priority notification, the audio output module may then playback an audio signal associated with the notification in the first acoustic soundstage zone.

In some embodiments, the audio output module may adjust interaural level differences (ILD) and interaural time differences (ITD) so as to change an apparent location of the source of various audio signals. As such, the apparent location of the audio signals may be moved around a user (front, back, left, right, above, below, etc.) as well as moved closer to and farther from the user.

In an example embodiment, when listening to music, a user may perceive the audio signal associated with the music to be coming from a front soundstage zone. When a notification is received, the audio output module may respond by adjusting the audio playback based on a priority of the notification. For a high priority notification, the music may be "ducked" by moving it to a rear soundstage zone and optionally attenuating its volume. After ducking the music, the audio signal associated with the notification may be played in the front soundstage zone. For a low priority notification, the music need not be ducked, and the notification may be played in the rear soundstage zone.

A notification may be assigned a priority level based on a variety of attributes of the notification. For example, the notification may be associated with a communication type such as an e-mail, a text, an incoming phone call or video call, etc. Each communication type may be assigned a priority level (e.g., calls are assigned high priority, e-mails are assigned low priority, etc.). Additionally or alternatively, priority levels may be assigned based on the source of the communication. For example, in the case where a known contact is the source of an e-mail, the associated notification may be assigned a high priority. In such a scenario, an e-mail from an unknown contact may be assigned a low priority.

In an example embodiment, the methods and systems described herein may determine a priority level of a notification based on a situational context. For example, a text message from a known contact may be assigned a low priority if the user is engaged in an activity requiring concentration, such as driving or biking. In other embodiments, the priority level of a notification may be determined based on an operational context of the computing device. For example, if a battery charge level of the computing device is critically low, the corresponding notification may be determined to be high priority.

Alternative or additionally, in response to determining that the user is in conversation (e.g., using a microphone or microphone array), the audio output module may adjust the playback of the audio signals so as to move them to a rear soundstage zone and optionally attenuate the audio signals.

In an example embodiment, ducking of the audio signal may include a spatial transition of the audio signal. That is, an apparent location of the source of the audio signal may be moved from a first soundstage zone to a second soundstage zone through a third soundstage zone (e.g., an intermediate, or adjacent, soundstage zone).

In the disclosed systems and methods, audio signals may be moved within a user's soundstage so as to reduce distractions (e.g., during a conversation) and/or to improve recognition of notifications. Furthermore, the systems and methods described herein may help users disambiguate distinct audio signals (e.g., music and audio notifications) by keeping them spatially distinct and/or spatially separated within the user's soundstage.

II. Example Devices

FIG. 1 illustrates a schematic diagram of a computing device 100, according to an example embodiment. The computing device 100 includes an audio output device 110, audio information 120, a communication interface 130, a user interface 140, and a controller 150. The user interface 140 may include at least one microphone 142 and controls 144. The controller 150 may include a processor 152 and a memory 154, such as a non-transitory computer readable medium.

The audio output device 110 may include one or more devices configured to convert electrical signals into audible signals (e.g. sound pressure waves). As such, the audio output device 110 may take the form of headphones (e.g., over-the-ear headphones, on-ear headphones, ear buds, wired and wireless headphones, etc.), one or more loudspeakers, or an interface to such an audio output device (e.g., a ¼" or ⅛" tip-ring-sleeve (TRS) port, a USB port, etc.). In an example embodiment, the audio output device 110 may include an amplifier, a communication interface (e.g., BLUETOOTH interface), and/or a headphone jack or speaker output terminals. Other systems or devices configured to deliver perceivable audio signals to a user are possible.

The audio information 120 may include information indicative of one or more audio signals. For example, the audio information 120 may include information indicative of music, a voice recording (e.g., a podcast, a comedy set, spoken word, etc.), an audio notification, or another type of audio signal. In some embodiments, the audio information 120 may be stored, temporarily or permanently, in the memory 154. The computing device 100 may be configured to play audio signals via audio output device 110 based on the audio information 120.

The communication interface 130 may allow computing device 100 to communicate, using analog or digital modulation, with other devices, access networks, and/or transport networks. Thus, communication interface 130 may facilitate circuit-switched and/or packet-switched communication, such as plain old telephone service (POTS) communication and/or Internet protocol (IP) or other packetized communication. For instance, communication interface 130 may include a chipset and antenna arranged for wireless communication with a radio access network or an access point. Also, communication interface 130 may take the form of or include a wireline interface, such as an Ethernet, Universal Serial Bus (USB), or High-Definition Multimedia Interface (HDMI) port. Communication interface 130 may also take the form of or include a wireless interface, such as a Wifi, BLUETOOTH®, global positioning system (GPS), or wide-area wireless interface (e.g., WiMAX or 3GPP Long-Term Evolution (LTE)). However, other forms of physical layer interfaces and other types of standard or proprietary communication protocols may be used over communication interface 130. Furthermore, communication interface 130 may comprise multiple physical communication interfaces (e.g., a Wifi interface, a BLUETOOTH® interface, and a wide-area wireless interface).

In an example embodiment, the communication interface 130 may be configured to receive information indicative of an audio signal and store it, at least temporarily, as audio information 120. For example, the communication interface 130 may receive information indicative of a phone call, a notification, or another type of audio signal. In such a scenario, the communication interface 130 may route the received information to the audio information 120, to the controller 150, and/or to the audio output device 110.

The user interface 140 may include at least one microphone 142 and controls 144. The microphone 142 may include an omni-directional microphone or a directional microphone. Further, an array of microphones could be implemented. In an example embodiment, two microphones may be arranged to detect speech by a wearer or user of the computing device 100. The two microphones 142 may direct a listening beam toward a location that corresponds to a wearer's mouth, when the computing device 100 is worn or positioned near a user's mouth. The microphones 142 may also detect sounds in the wearer's environment, such as the ambient speech of others in the vicinity of the wearer. Other microphone configurations and combinations are contemplated.

The controls 144 may include any combination of switches, buttons, touch-sensitive surfaces, and/or other user input devices. A user may monitor and/or adjust the operation of the computing device 100 via the controls 144. The controls 144 may be used to trigger one or more of the operations described herein.

The controller 150 may include at least one processor 152 and a memory 154. The processor 152 may include one or more general purpose processors—e.g., microprocessors—and/or one or more special purpose processors—e.g., image signal processors (ISPs), digital signal processors (DSPs), graphics processing units (GPUs), floating point units (FPUs), network processors, or application-specific integrated circuits (ASICs). In an example embodiment, the controller 150 may include one or more audio signal processing devices or audio effects units. Such audio signal processing devices may process signals in analog and/or digital audio signal formats. Additionally or alternatively, the processor 152 may include at least one programmable in-circuit serial programming (ICSP) microcontroller. The memory 154 may include one or more volatile and/or non-volatile storage components, such as magnetic, optical, flash, or organic storage, and may be integrated in whole or in part with the processor 152. Memory 154 may include removable and/or non-removable components.

Processor 152 may be capable of executing program instructions (e.g., compiled or non-compiled program logic and/or machine code) stored in memory 154 to carry out the various functions described herein. Therefore, memory 154 may include a non-transitory computer-readable medium, having stored thereon program instructions that, upon execution by computing device 100, cause computing device 100 to carry out any of the methods, processes, or operations disclosed in this specification and/or the accompanying drawings. The execution of program instructions by processor 152 may result in processor 152 using data provided by various other elements of the computing device 100. Specifically, the controller 150 and the processor 152 may perform operations on audio information 120. In an example embodiment, the controller 150 may include a distributed computing network and/or a cloud computing network.

In an example embodiment, the computing device 100 may be operable to play back audio signals processed by the controller 150. Such audio signals may encode spatial audio information in various ways. For example, the computing device 100 and the controller 150 may provide, or playout, stereophonic audio signals that achieve stereo "separation" of two or more channels (e.g., left and right channels) via volume and/or phase differences of elements in the respective channels. However, in some cases, stereophonic recordings may provide a limited acoustic soundstage (e.g., an arc of approximately 30° to the front of the listener when listening to speakers) at least due to crosstalk interference between the left and right audio signals.

In an example embodiment, the computing device 100 may be configured to playout "binaural" audio signals. Binaural audio signals may be recorded by two microphones separated by a dummy or mannequin head. Furthermore, the binaural audio signals may be recorded taking into account natural ear spacing (e.g., seven inches between microphones). The binaural audio recordings may be made so as to accurately capture psychoacoustic information (e.g., interaural level differences (ILD) and interaural time differences (ITD)) according to a specific or generic head-related transfer function (HRTF). Binaural audio recordings may provide a very wide acoustic soundstage to listeners. For instance, while listening to binaural audio signals, some users may be able to perceive a source location of the audio within a full 360° arc around their head. Furthermore, some users may perceive binaural audio signals as originating "within" their head (e.g., inside the listener's head).

Yet further, the computing device 100 may be configured to playout "Ambisonics" recordings using various means, such as stereo headphones (e.g., a stereo dipole). Ambisonics is a method that provides more accurate 3D sound reproduction via digital signal processing, e.g. via the controller 150. For example, Ambisonics may provide binaural listening experiences using headphones, which may be perceived similar to binaural playback using speakers. Ambisonics may provide a wider acoustic soundstage in which users may perceive audio. In an example embodiment, Ambisonics audio signals may be reproduced within an approximately 150° arc to the front of a listener. Other acoustic soundstage sizes and shapes are possible.

In an example embodiment, the controller 150 may be configured to spatially process audio signals so that they may be perceived by a user to originate from one or more various zones, locations, or regions inside or around the user. That is, the controller 150 may spatially process audio signals such that they have an apparent source location inside, left, right, ahead, behind, top, or below the user. Among other spatial processing methods, the controller 150 may be configured to adjust ILD and ITD so as to adjust the apparent source location of the audio signals. In other words, by adjusting ILD and ITD, the controller 150 may direct playback of the audio signal (via the audio output device 110) to a controllable apparent source location in or around the user.

In some embodiments, the apparent source location of the audio signal(s) may be at or near a given distance away from the user. For example, the controller 150 may spatially process an audio signal to provide an apparent source location of 1 meter away from the user. The controller 150 may additionally or alternatively spatially process the audio signal with an apparent source location of 10 meters away from the user. Spatial processing to achieve other relative positions (e.g., distances and directions) between the user and an apparent source location of the audio signal(s) are possible. In yet further embodiments, the controller 150 may spatially process the audio signal so as to provide an apparent source location inside the user's head. That is, the spatially-processed audio signal may be played via audio output device 110 such that it is perceived by the user as having a source location inside his or her head.

In an example embodiment, as described above, the controller 150 may spatially process the audio signals so that they may be perceived as having a source (or sources) in various regions in or around the user. In such a scenario, an example acoustic soundstage may include several regions around the user. In an example embodiment, the acoustic soundstage may include radial wedges or cones projecting outward from the user. As an example, the acoustic soundstage may include eight radial wedges, each of which share a central axis. The central axis may be defined as an axis that passes through the user's head from bottom to top. In an example embodiment, the controller 150 may spatially process music so as to be perceptible as originating from a first acoustic soundstage zone, which may be defined as roughly a 30 degree wedge or cone directed outward toward the front of the user. The acoustic soundstage zones may be shaped similarly or differently from one another. For example, acoustic soundstage zones may be smaller in wedge angle to the front of the user as compared with zones to the rear of the user. Other shapes of acoustic soundstage zones are possible and contemplated herein.

The audio signals may be processed in various ways so as to be perceived by a listener as originating from various regions and/or distances with respect to the listener. In an example embodiment, for each audio signal, an angle (A), an elevation (E), and a distance (D) may be controlled at any given time during playout. Furthermore, each audio signal may be controlled to move along a given "trajectory" that may correspond with a smooth transition from at least one soundstage zone to another.

In an example embodiment, an audio signal may be attenuated according to a desired distance away from the audio source. That is, distant sounds may be attenuated by a factor $(1/D)^{Speaker\ Distance}$, where Speaker Distance is a unit distance away from a playout speaker and D is the relative distance with respect to the Speaker Distance. That is, sounds "closer" than the Speaker Distance may be increased in amplitude, and sounds "far away" from the speaker may be reduced in amplitude.

Other signal processing is contemplated. For example, local and/or global reverberation ("reverb") effects may be applied to or removed from a given audio signal. In some embodiments, audio filtering may be applied. For example, a lowpass filter may be applied to distant sounds. Spatial imaging effects (walls, ceiling, floor) may be applied to a given audio signal by providing "early reflection" information, e.g., specular and diffuse audio reflections. Doppler encoding is possible. For example, a resulting frequency $f'=f(c/(c-v))$, where f is an emitted source frequency, c is the speed of sound at a given altitude, and v is the speed of the source with respect to a listener.

As an example embodiment, Ambisonic information may be provided in four channels, W (omnidirectional information), X (x-directional information), Y (y-directional information), and Z (z-directional information). Specifically, $$W = \frac{1}{k}\sum_{i=1}^{k} s_i\left[\frac{1}{\sqrt{2}}\right]$$

$$X=1/k\Sigma_{i=1}^{k}s_i[\cos\phi_i\cos\theta_i]$$

$$Y=1/k\Sigma_{i=1}^{k}s_i[\sin\phi_i\cos\theta_i]$$

$$Z=1/k\Sigma_{i=1}^{k}s_i\sin\theta_i,$$

where $s_i$ is an audio signal for encoding at a given spatial position $\phi_i$ (horizontal angle, azimuth) and $\theta_i$ (vertical angle, theta).

In an example embodiment, audio signals described herein may be captured via one or more soundfield microphones so as to record an entire soundfield of a given audio source. However, traditional microphone recording techniques are also contemplated herein.

During playout, the audio signals may be decoded in various ways. For instance, the audio signals may be decoded based on a placement of speakers with respect to a listener. In an example embodiment, an Ambisonic decoder may provide a weighted sum of all Ambisonic channels to a given speaker. That is, a signal provided to the j-th loudspeaker may be expressed as:

$$p_j = \frac{1}{N}\left[W\left(\frac{1}{\sqrt{2}}\right) + X(\cos\varphi_j\cos\theta_j) + Y(\sin\varphi_j\cos\theta_j) + Z(\sin\theta_j)\right],$$

where $\phi_j$ (horizontal angle, azimuth) and $\theta_j$ (vertical angle, theta) are given for a position of the j-th speaker for N Ambisonic channels.

While the above examples describe Ambisonic audio encoding and decoding, the controller 150 may be operable to process audio signals according to higher order Ambisonic methods and/or another type of periphonic (e.g., 3D) audio reproduction system.

The controller 150 may be configured to spatially process audio signals from two or more audio content sources at the same time, e.g., concurrently, and/or in a temporally overlapping fashion. That is, the controller 150 may spatially process music and an audio notification at the same time. Other combinations of audio content may be spatially processed concurrently. Additionally or alternatively, the content of each audio signal may be spatially processed so as to originate from the same acoustic soundstage zone or from different acoustic soundstage zones.

While FIG. 1 illustrates the controller 150 as being schematically apart from other elements of the computing device 100, the controller 150 may be physically located at, or incorporated into, one or more elements of the computing device 100. For example, the controller 150 may be incorporated into the audio output device 110, the communication interface 130, and/or the user interface 140. Additionally or alternatively, one or more elements of the computing device 100 may be incorporated into the controller 150 and/or its constituent elements. For example, audio information 120 may reside, temporarily or permanently, in the memory 154.

As described above, the memory 154 may store program instructions that, when executed by the processor 152, cause the computing device to perform operations. That is, the controller 150 may be operable to carry out various operations as described herein. For example, the controller 150 may be operable to drive the audio output device 110 with a first audio signal, as described elsewhere herein. The audio information 120 may include information indicative of the first audio signal. The content of the first audio signal may include any type of audio signal. For example, the first audio signal may include music, a voice recording (e.g., a podcast, a comedy set, spoken word, etc.), an audio notification, or another type of audio signal.

The controller 150 may also be operable to receive an indication to provide a notification associated with a second audio signal. The notification may be received via the communication interface 130. Additionally or alternatively, the notification may be received based on a determination by the controller 150 and/or a past, current, or future state of the computing device 100. The second audio signal may include any sound that may be associated with the notification. For example, the second audio signal may include, but is not limited to, a chime, a ring, a tone, an alarm, music, an audio message, or another type of notification sound or audio signal.

The controller 150 may be operable to determine, based on an attribute of the notification, that the notification has a higher priority than playout of the first audio signal. That is, the notification may include information indicative of an absolute or relative priority of the notification. For example, the notification may be marked "high priority" or "low priority" (e.g., in metadata or another type of tag or information). In such scenarios, the controller 150 may determine the notification condition as having a "higher priority" or a "lower priority" with respect to the playout of the first audio signal, respectively.

In some embodiments, the priority of the notification may be determined, at least in part, based on a current operating mode of the computing device 100. That is, the computing device 100 may be playing an audio signal (e.g., music, a podcast, etc.) when a notification is received. In such a scenario, the controller 150 may determine the notification condition as being "low priority" so as to not disturb the wearer of the computing device 100.

In an example embodiment, the priority of the notification may additionally or alternatively be determined based on a current or anticipated behavior of the user of the computing device 100. For example, the computing device 100 and the controller 150 may be operable to determine a situational context based on one or more sensors (e.g., microphone, GPS unit, accelerometer, camera, etc.). That is, the computing device 100 may be operable to detect a contextual indication of a user activity, and the priority of the notification may be based upon the situational context or contextual indication.

For example, the computing device 100 may be configured to listen to an acoustic environment around the computing device 100 for indications that the user is speaking and/or in conversation. In such cases, a received notification, and its corresponding priority, may be determined by the controller 150 to be "low priority" to avoid distracting or interrupting the user. Other user actions/behaviors may cause the controller 150 to determine incoming notification conditions to be "low priority" by default. For example, user actions may include, but are not limited to, driving, running, listening, sleeping, studying, biking, exercising/working out, an emergency, and other activities that may require user concentration and/or concentration.

As an example, if the user is determined by the controller 150 to be driving a car, incoming notifications may be assigned "low priority" by default so as to not distract the user while driving. As another example, if the user is determined by the controller 150 to be sleeping, incoming notifications may be assigned "low priority" by default so as to not awaken the user.

In some embodiments, the controller 150 may determine the notification priority to be "high priority" or "low priority" with respect to playout of the first audio signal based on a type of notification. For example, incoming call notifications may be determined, by default, as "high priority," while incoming text notifications may be determined, by default, as "low priority." Additionally or alternatively, incoming video calls, calendar reminders, incoming email messages, or other types of notifications may each be assigned an absolute priority level or a relative priority level with respect to other types of notifications and/or the playout of the first audio signal.

Additionally or alternatively, the controller 150 may determine the notification priority to be "high priority" or "low priority" based on a source of the notification. For example, the computing device 100 or another computing device may maintain a list of notification sources (e.g., a contacts list, a high priority list, a low priority list, etc.). In such a scenario, when a notification is received, a sender or source of the incoming notification may be cross-referenced with the list. If, for example, the source of the notification matches a known contact on a contacts list, the controller 150 may determine the notification priority to have a higher priority than the playout of the first audio signal. Additionally or alternatively, if the source of the notification does not match any contact on the contacts list, the controller 150 may determine the notification priority to be "low priority." Other types of determinations are possible based on the source of the notification.

In some embodiments, the controller 150 may determine the notification priority based on an upcoming or recurring calendar event and/or other information. For example, the user of the computing device 100 may have reserved a flight leaving soon from a nearby airport. In such a scenario, light of the GPS location of the computing device 100, the computing device 100 may provide a high priority notification to the user of the computing device 100. For example, the notification may include an audio message such as "Your flight is leaving in two hours, you should leave the house within 5 minutes."

In an example embodiment, the computing device 100 may include a virtual assistant. The virtual assistant may be configured to provide information to, and carry out actions for, the user of the computing device 100. In some embodiments, the virtual assistant may be configured to interact with the user with natural language audio notifications. For example, the user may request that the virtual assistant make a lunch reservation. In response, the virtual assistant may make the reservation via an online reservation website and confirm, via a natural language notification to the user, that the lunch reservation has been made. Furthermore, the virtual assistant may provide notifications to remind the user of the upcoming lunch reservation. The notification may be determined to be high priority if the lunch reservation is imminent. Furthermore, the notification may include information relating to the event, such as the weather, event time, and amount of time before departure. For example, a high priority audio notification may include "You have a reservation for lunch at South Branch at 12:30 PM. You should leave the office within five minutes. It's raining, bring an umbrella."

Upon determining the notification priority to be "high priority", the controller 150 may be operable to spatially duck the first audio signal. In spatially ducking the first audio signal, the controller 150 may spatially process the first audio signal so as to move an apparent source location of the first audio signal to a given soundstage zone. Additionally, the controller 150 may spatially process the second audio signal such that it is perceivable in a different soundstage zone. In some embodiments, the controller 150 may spatially process the second audio signal such that it is perceivable as originating in the first acoustic soundstage zone. Furthermore, the controller 150 may spatially process the first audio signal such that it is perceivable in a second acoustic soundstage zone. In some embodiments, the respective audio signals may be perceivable as originating in, or moving through, a third acoustic soundstage zone.

In an example embodiment, spatially ducking the first audio signal may include the controller 150 adjusting the first audio signal to attenuate its volume or to increase an apparent source distance with respect to the user of the computing device 100.

Furthermore, spatial ducking of the first audio signal may include spatially processing the first audio signal by the controller 150 for a predetermined length of time. For example, the first audio signal may be spatially processed for a predetermined length of time equal to the duration of the second audio signal before such spatial processing is discontinued or adjusted. That is, upon the predetermined length of time elapsing, the spatial ducking of the first audio signal may be discontinued. Other predetermined lengths of time are possible.

Upon determining a low priority notification condition, the computing device 100 may maintain playing the first audio signal normally or with an apparent source location in a given acoustic soundstage zone. The second audio signal associated with the low priority notification may be spatially processed by the controller 150 so as to be perceivable in a second acoustic soundstage zone (e.g., in a rear soundstage zone). In some embodiments, upon determining a low priority notification condition, the associated notification may be ignored altogether or the notification may be delayed until a given time, such as after a higher priority activity has been completed. Alternatively or additionally, low priority notifications may be consolidated into one or more digest notifications or summary notifications. For example, if several voice mail notifications are determined to be low priority, the notifications may be bundled or consolidated into a single summary notification, which may be delivered to the user at a later time.

In an example embodiment, the computing device 100 may be configured to facilitate voice-based user interactions. However, in other embodiments, computing device 100 need not facilitate voice-based user interactions.

Computing device 100 may be provided as having a variety of different form factors, shapes, and/or sizes. For example, the computing device 100 may include a head-mountable device that and has a form factor similar to traditional eyeglasses. Additionally or alternatively, the computing device 100 may take the form of an earpiece.

The computing device 100 may include one or more devices operable to deliver audio signals to a user's ears and/or bone structure. For example, the computing device 100 may include one or more headphones and/or bone conduction transducers or "BCTs". Other types of devices configured to provide audio signals to a user are contemplated herein.

As a non-limiting example, headphones may include "in-ear", "on-ear", or "over-ear" headphones. "In-ear" headphones may include in-ear headphones, earphones, or earbuds. "On-ear" headphones may include supra-aural headphones that may partially surround one or both ears of a user. "Over-ear" headphones may include circumaural headphones that may fully surround one or both ears of a user.

The headphones may include one or more transducers configured to convert electrical signals to sound. For example, the headphones may include electrostatic, electret, dynamic, or another type of transducer.

A BCT may be operable to vibrate the wearer's bone structure at a location where the vibrations travel through the wearer's bone structure to the middle ear, such that the brain interprets the vibrations as sounds. In an example embodiment, a computing device 100 may include, or be coupled to one or more ear-pieces that include a BCT.

The computing device 100 may be tethered via a wired or wireless interface to another computing device (e.g., a user's smartphone). Alternatively, the computing device 100 may be a standalone device.

FIGS. 2A-2D illustrate several non-limiting examples of wearable devices as contemplated in the present disclosure. As such, the computing device 100 as illustrated and described with respect to FIG. 1 may take the form of any of wearable devices 200, 230, or 250, or computing device 260. The computing device 100 may take other forms as well.

Figure 2A:
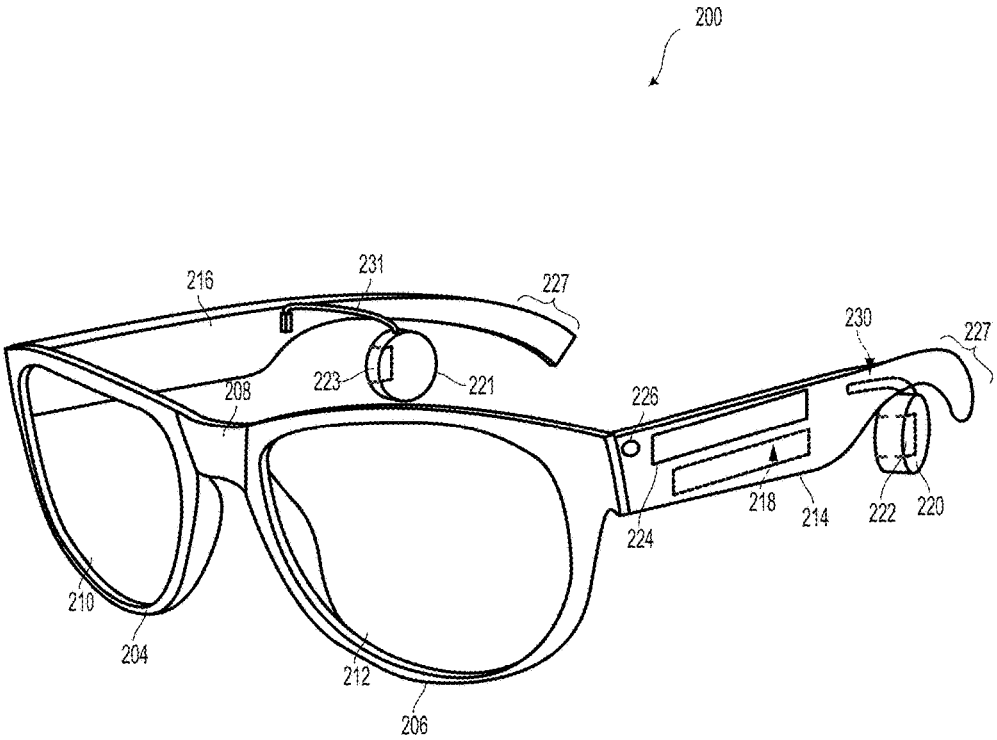
FIG. 2A illustrates a wearable device, according to example embodiments.

FIG. 2A illustrates a wearable device 200, according to example embodiments. Wearable device 200 may be shaped similar to a pair of glasses or another type of head-mountable device. As such, the wearable device 200 may include frame elements including lens-frames 204, 206 and a center frame support 208, lens elements 210, 212, and extending side-arms 214, 216. The center frame support 208 and the extending side-arms 214, 116 are configured to secure the wearable device 200 to a user's head via placement on a user's nose and ears, respectively.

Each of the frame elements 204, 206, and 208 and the extending side-arms 214, 216 may be formed of a solid structure of plastic and/or metal, or may be formed of a hollow structure of similar material so as to allow wiring and component interconnects to be internally routed through the wearable device 200. Other materials are possible as well. Each of the lens elements 210, 212 may also be sufficiently transparent to allow a user to see through the lens element.

Additionally or alternatively, the extending side-arms 214, 216 may be positioned behind a user's ears to secure the wearable device 200 to the user's head. The extending side-arms 214, 216 may further secure the wearable device 200 to the user by extending around a rear portion of the user's head. Additionally or alternatively, for example, the wearable device 200 may connect to or be affixed within a head-mountable helmet structure. Other possibilities exist as well.

The wearable device 200 may also include an on-board computing system 218 and at least one finger-operable touch pad 224. The on-board computing system 218 is shown to be integrated in side-arm 214 of wearable device 200. However, an on-board computing system 218 may be provided on or within other parts of the wearable device 200 or may be positioned remotely from, and communicatively coupled to, a head-mountable component of a computing device (e.g., the on-board computing system 218 could be housed in a separate component that is not head wearable, and is wired or wirelessly connected to a component that is head wearable). The on-board computing system 218 may include a processor and memory, for example. Further, the on-board computing system 218 may be configured to receive and analyze data from a finger-operable touch pad 224 (and possibly from other sensory devices and/or user interface components).

In a further aspect, the wearable device 200 may include various types of sensors and/or sensory components. For instance, the wearable device 200 could include an inertial measurement unit (IMU) (not explicitly illustrated in FIG. 2A), which provides an accelerometer, gyroscope, and/or magnetometer. In some embodiments, the wearable device 200 could also include an accelerometer, a gyroscope, and/or a magnetometer that is not integrated in an IMU.

In a further aspect, the wearable device 200 may include sensors that facilitate a determination as to whether or not the wearable device 200 is being worn. For instance, sensors such as an accelerometer, gyroscope, and/or magnetometer could be used to detect motion that is characteristic of the wearable device 200 being worn (e.g., motion that is characteristic of user walking about, turning their head, and so on), and/or used to determine that the wearable device 200 is in an orientation that is characteristic of the wearable device 200 being worn (e.g., upright, in a position that is typical when the wearable device 200 is worn over the ear). Accordingly, data from such sensors could be used as input to an on-head detection process. Additionally or alternatively, the wearable device 200 may include a capacitive sensor or another type of sensor that is arranged on a surface of the wearable device 200 that typically contacts the wearer when the wearable device 200 is worn. Accordingly data provided by such a sensor may be used to determine whether the wearable device 200 is being worn. Other sensors and/or other techniques may also be used to detect when the wearable device 200 is being worn.

The wearable device 200 also includes at least one microphone 226, which may allow the wearable device 200 to receive voice commands from a user. The microphone 226 may be a directional microphone or an omni-directional microphone. Further, in some embodiments, the wearable device 200 may include a microphone array and/or multiple microphones arranged at various locations on the wearable device 200.

In FIG. 2A, touch pad 224 is shown as being arranged on side-arm 214 of the wearable device 200. However, the finger-operable touch pad 224 may be positioned on other parts of the wearable device 200. Also, more than one touch pad may be present on the wearable device 200. For example, a second touchpad may be arranged on side-arm 216. Additionally or alternatively, a touch pad may be arranged on a rear portion 227 of one or both side-arms 214 and 216. In such an arrangement, the touch pad may arranged on an upper surface of the portion of the side-arm that curves around behind a wearer's ear (e.g., such that the touch pad is on a surface that generally faces towards the rear of the wearer, and is arranged on the surface opposing the surface that contacts the back of the wearer's ear). Other arrangements of one or more touch pads are also possible.

The touch pad 224 may sense contact, proximity, and/or movement of a user's finger on the touch pad via capacitive sensing, resistance sensing, or a surface acoustic wave process, among other possibilities. In some embodiments, touch pad 224 may be a one-dimensional or linear touchpad, which is capable of sensing touch at various points on the touch surface, and of sensing linear movement of a finger on the touch pad (e.g., movement forward or backward along the touch pad 224). In other embodiments, touch pad 224 may be a two-dimensional touch pad that is capable of sensing touch in any direction on the touch surface. Additionally, in some embodiments, touch pad 224 may be configured for near-touch sensing, such that the touch pad can sense when a user's finger is near to, but not in contact with, the touch pad. Further, in some embodiments, touch pad 224 may be capable of sensing a level of pressure applied to the pad surface.

In a further aspect, earpiece 220 and 211 are attached to side-arms 214 and 216, respectively. Earpieces 220 and 221 may each include a BCT 222 and 223, respectively. Each earpiece 220, 221 may be arranged such that when the wearable device 200 is worn, each BCT 222, 223 is positioned to the posterior of a wearer's ear. For instance, in an exemplary embodiment, an earpiece 220, 221 may be arranged such that a respective BCT 222, 223 can contact the auricle of both of the wearer's ears and/or other parts of the wearer's head. Other arrangements of earpieces 220, 221 are also possible. Further, embodiments with a single earpiece 220 or 221 are also possible.

In an exemplary embodiment, BCT 222 and/or BCT 223 may operate as a bone-conduction speaker. BCT 222 and 223 may be, for example, a vibration transducer or an electro-acoustic transducer that produces sound in response to an electrical audio signal input. Generally, a BCT may be any structure that is operable to directly or indirectly vibrate the bone structure of the user. For instance, a BCT may be implemented with a vibration transducer that is configured to receive an audio signal and to vibrate a wearer's bone structure in accordance with the audio signal. More generally, it should be understood that any component that is arranged to vibrate a wearer's bone structure may be incorporated as a bone-conduction speaker, without departing from the scope of the invention.

In a further aspect, wearable device 200 may include at least one audio source (not shown) that is configured to provide an audio signal that drives BCT 222 and/or BCT 223. As an example, the audio source may provide information that may be stored and/or used by computing device 100 as audio information 120 as illustrated and described in reference to FIG. 1. In an exemplary embodiment, the wearable device 200 may include an internal audio playback device such as an on-board computing system 218 that is configured to play digital audio files. Additionally or alternatively, the wearable device 200 may include an audio interface to an auxiliary audio playback device (not shown), such as a portable digital audio player, a smartphone, a home stereo, a car stereo, and/or a personal computer, among other possibilities. In some embodiments, an application or software-based interface may allow for the wearable device 200 to receive an audio signal that is streamed from another computing device, such as the user's mobile phone. An interface to an auxiliary audio playback device could additionally or alternatively be a tip, ring, sleeve (TRS) connector, or may take another form. Other audio sources and/or audio interfaces are also possible.

Further, in an embodiment with two ear-pieces 222 and 223, which both include BCTs, the ear-pieces 220 and 221 may be configured to provide stereo and/or Ambisonic audio signals to a user. However, non-stereo audio signals (e.g., mono or single channel audio signals) are also possible in devices that include two ear-pieces.

As shown in FIG. 2A, the wearable device 200 need not include a graphical display. However, in some embodiments, the wearable device 200 may include such a display. In particular, the wearable device 200 may include a near-eye display (not explicitly illustrated). The near-eye display may be coupled to the on-board computing system 218, to a standalone graphical processing system, and/or to other components of the wearable device 200. The near-eye display may be formed on one of the lens elements of the wearable device 200, such as lens element 210 and/or 212. As such, the wearable device 200 may be configured to overlay computer-generated graphics in the wearer's field of view, while also allowing the user to see through the lens element and concurrently view at least some of their real-world environment. In other embodiments, a virtual reality display that substantially obscures the user's view of the surrounding physical world is also possible. The near-eye display may be provided in a variety of positions with respect to the wearable device 200, and may also vary in size and shape.

Other types of near-eye displays are also possible. For example, a glasses-style wearable device may include one or more projectors (not shown) that are configured to project graphics onto a display on a surface of one or both of the lens elements of the wearable device 200. In such a configuration, the lens element(s) of the wearable device 200 may act as a combiner in a light projection system and may include a coating that reflects the light projected onto them from the projectors, towards the eye or eyes of the wearer. In other embodiments, a reflective coating need not be used (e.g., when the one or more projectors take the form of one or more scanning laser devices).

As another example of a near-eye display, one or both lens elements of a glasses-style wearable device could include a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame of the wearable device 200 for driving such a matrix display. Alternatively or additionally, a laser or LED source and scanning system could be used to draw a raster display directly onto the retina of one or more of the user's eyes. Other types of near-eye displays are also possible.

Figure 2B:
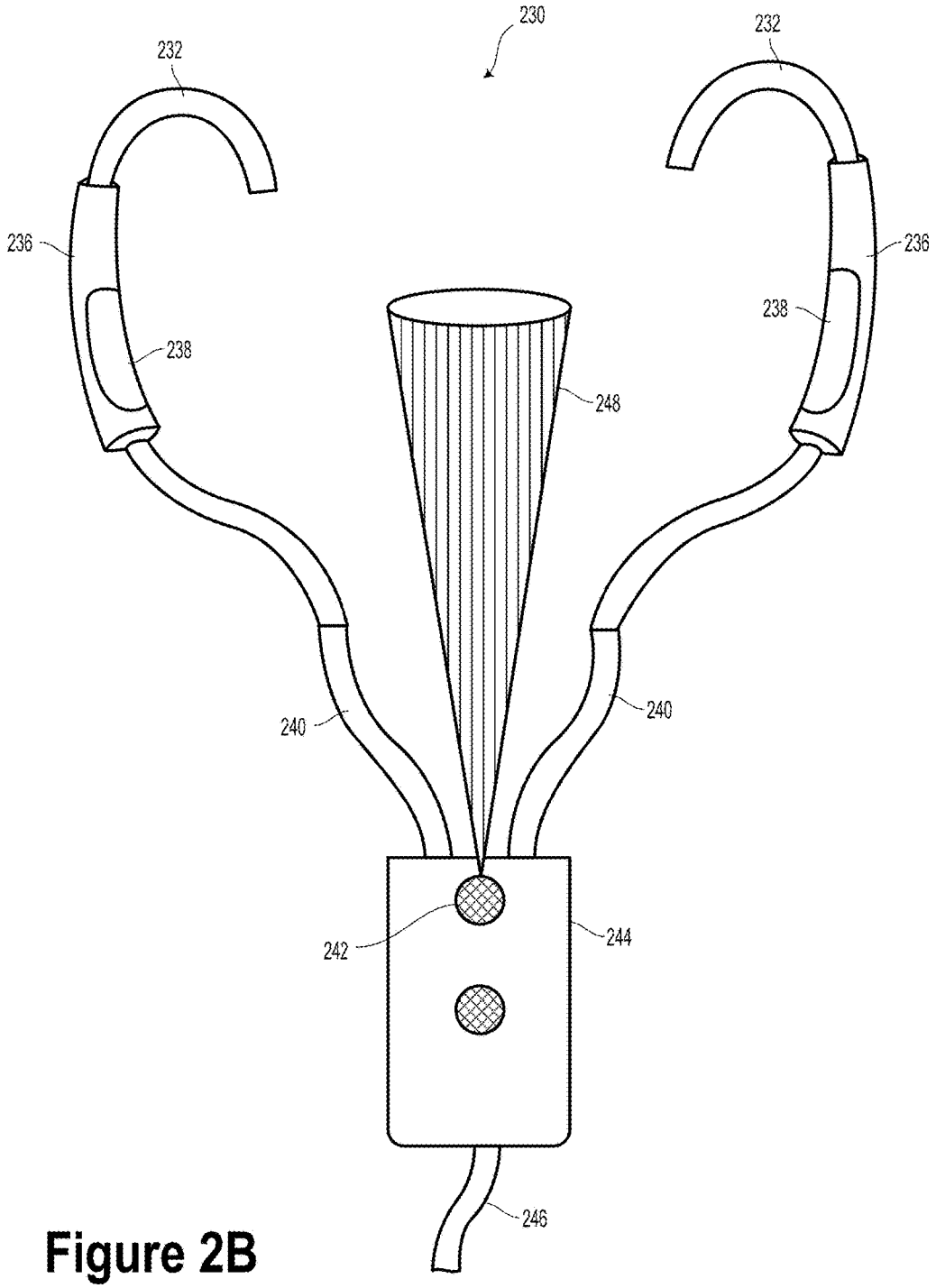
FIG. 2B illustrates a wearable device, according to example embodiments.

FIG. 2B illustrates a wearable device 230, according to an example embodiment. The device 300 includes two frame portions 232 shaped so as to hook over a wearer's ears. When worn, a behind-ear housing 236 is located behind each of the wearer's ears. The housings 236 may each include a BCT 238. BCT 238 may be, for example, a vibration transducer or an electro-acoustic transducer that produces sound in response to an electrical audio signal input. As such, BCT 238 may function as a bone-conduction speaker that plays audio to the wearer by vibrating the wearer's bone structure. Other types of BCTs are also possible. Generally, a BCT may be any structure that is operable to directly or indirectly vibrate the bone structure of the user.

Note that the behind-ear housing 236 may be partially or completely hidden from view, when the wearer of the device 230 is viewed from the side. As such, the device 230 may be worn more discretely than other bulkier and/or more visible wearable computing devices.

As shown in FIG. 2B, the BCT 238 may be arranged on or within the behind-ear housing 236 such that when the device 230 is worn, BCT 238 is positioned posterior to the wearer's ear, in order to vibrate the wearer's bone structure. More specifically, BCT 238 may form at least part of, or may be vibrationally coupled to the material that forms the behind-ear housing 236. Further, the device 230 may be configured such that when the device is worn, the behind-ear housing 236 is pressed against or contacts the back of the wearer's ear. As such, BCT 238 may transfer vibrations to the wearer's bone structure via the behind-ear housing 236. Other arrangements of a BCT on the device 230 are also possible.

In some embodiments, the behind-ear housing 236 may include a touchpad (not shown), similar to the touchpad 224 shown in FIG. 2A and described above. Further, the frame 232, behind-ear housing 236, and BCT 238 configuration shown in FIG. 2B may be replaced by ear buds, over-ear headphones, or another type of headphones or micro-speakers. These different configurations may be implemented by removable (e.g., modular) components, which can be attached and detached from the device 230 by the user. Other examples are also possible.

In FIG. 2B, the device 230 includes two cords 240 extending from the frame portions 232. The cords 240 may be more flexible than the frame portions 232, which may be more rigid in order to remain hooked over the wearer's ears during use. The cords 240 are connected at a pendant-style housing 244. The housing 244 may contain, for example, one or more microphones 242, a battery, one or more sensors, a processor, a communications interface, and onboard memory, among other possibilities.

A cord 246 extends from the bottom of the housing 244, which may be used to connect the device 230 to another device, such as a portable digital audio player, a smartphone, among other possibilities. Additionally or alternatively, the device 230 may communicate with other devices wirelessly, via a communications interface located in, for example, the housing 244. In this case, the cord 246 may be removable cord, such as a charging cable.

The microphones 242 included in the housing 244 may be omni-directional microphones or directional microphones. Further, an array of microphones could be implemented. In the illustrated embodiment, the device 230 includes two microphones arranged specifically to detect speech by the wearer of the device. For example, the microphones 242 may direct a listening beam 248 toward a location that corresponds to a wearer's mouth, when the device 230 is worn. The microphones 242 may also detect sounds in the wearer's environment, such as the ambient speech of others in the vicinity of the wearer. Additional microphone configurations are also possible, including a microphone arm extending from a portion of the frame 232, or a microphone located inline on one or both of the cords 240. Other possibilities for providing information indicative of a local acoustic environment are contemplated herein.

Figure 2C:
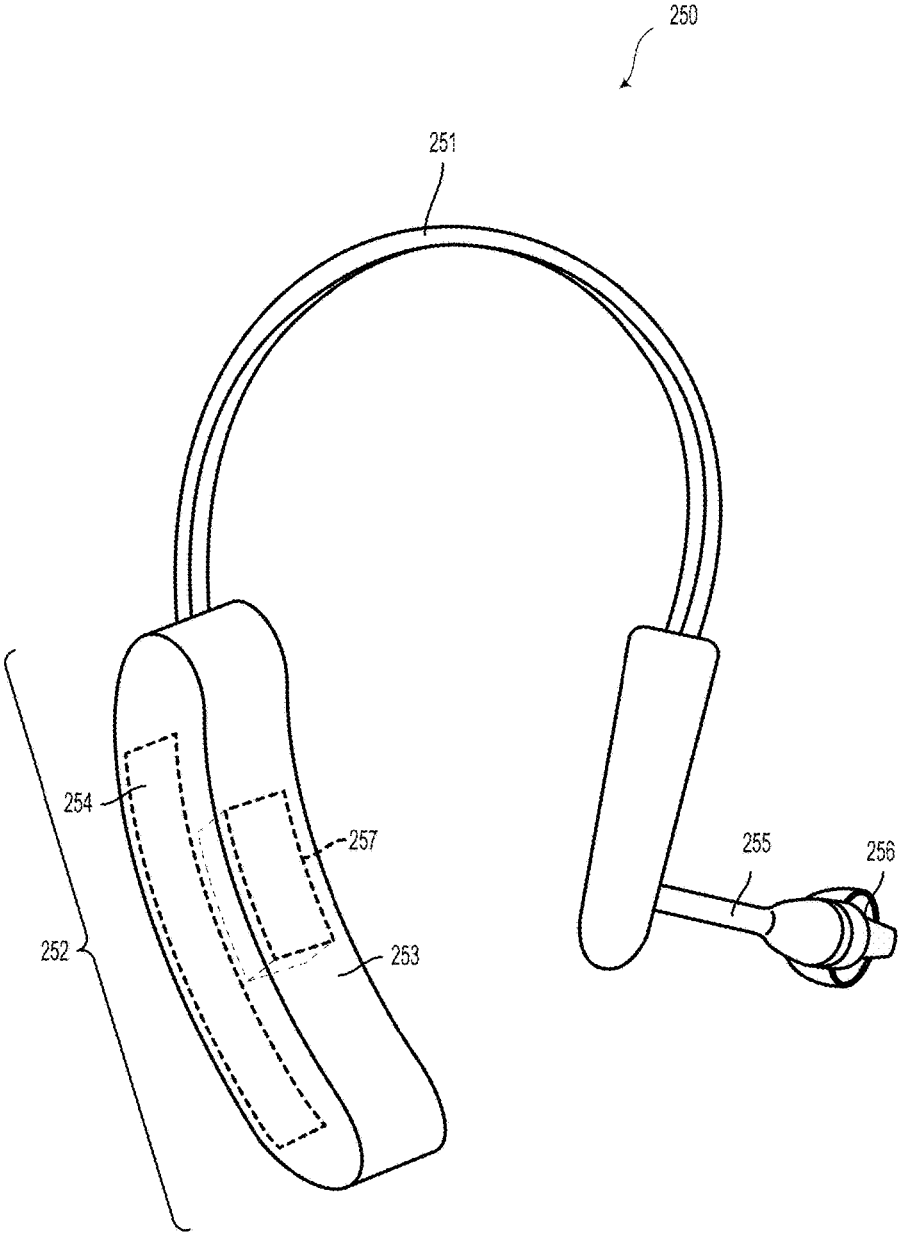
FIG. 2C illustrates a wearable device, according to example embodiments.

FIG. 2C illustrates a wearable device 250, according to an example embodiment. Wearable device 250 includes a frame 251 and a behind-ear housing 252. As shown in FIG. 2C, the frame 251 is curved, and is shaped so as to hook over a wearer's ear. When hooked over the wearer's ear(s), the behind-ear housing 252 is located behind the wearer's ear. For example, in the illustrated configuration, the behind-ear housing 252 is located behind the auricle, such that a surface 253 of the behind-ear housing 252 contacts the wearer on the back of the auricle.

Note that the behind-ear housing 252 may be partially or completely hidden from view, when the wearer of wearable device 250 is viewed from the side. As such, the wearable device 250 may be worn more discretely than other bulkier and/or more visible wearable computing devices.

The wearable device 250 and the behind-ear housing 252 may include one or more BCTs, such as the BCT 222 as illustrated and described with regard to FIG. 2A. The one or more BCTs may be arranged on or within the behind-ear housing 252 such that when the wearable device 250 is worn, the one or more BCTs may be positioned posterior to the wearer's ear, in order to vibrate the wearer's bone structure. More specifically, the one or more BCTs may form at least part of, or may be vibrationally coupled to the material that forms, surface 253 of behind-ear housing 252. Further, wearable device 250 may be configured such that when the device is worn, surface 253 is pressed against or contacts the back of the wearer's ear. As such, the one or more BCTs may transfer vibrations to the wearer's bone structure via surface 253. Other arrangements of a BCT on an earpiece device are also possible.

Furthermore, the wearable device 250 may include a touch-sensitive surface 254, such as touchpad 224 as illustrated and described in reference to FIG. 2A. The touch-sensitive surface 254 may be arranged on a surface of the wearable device 250 that curves around behind a wearer's ear (e.g., such that the touch-sensitive surface generally faces towards the wearer's posterior when the earpiece device is worn). Other arrangements are also possible.

Wearable device 250 also includes a microphone arm 255, which may extend towards a wearer's mouth, as shown in FIG. 2C. Microphone arm 255 may include a microphone 256 that is distal from the earpiece. Microphone 256 may be an omni-directional microphone or a directional microphone. Further, an array of microphones could be implemented on a microphone arm 255. Alternatively, a bone conduction microphone (BCM), could be implemented on a microphone arm 255. In such an embodiment, the arm 255 may be operable to locate and/or press a BCM against the wearer's face near or on the wearer's jaw, such that the BCM vibrates in response to vibrations of the wearer's jaw that occur when they speak. Note that the microphone arm 255 is optional, and that other configurations for a microphone are also possible.

In some embodiments, the wearable devices disclosed herein may include two types and/or arrangements of microphones. For instance, the wearable device may include one or more directional microphones arranged specifically to detect speech by the wearer of the device, and one or more omni-directional microphones that are arranged to detect sounds in the wearer's environment (perhaps in addition to the wearer's voice). Such an arrangement may facilitate intelligent processing based on whether or not audio includes the wearer's speech.

In some embodiments, a wearable device may include an ear bud (not shown), which may function as a typical speaker and vibrate the surrounding air to project sound from the speaker. Thus, when inserted in the wearer's ear, the wearer may hear sounds in a discrete manner. Such an ear bud is optional, and may be implemented by a removable (e.g., modular) component, which can be attached and detached from the earpiece device by the user.

Figure 2D:
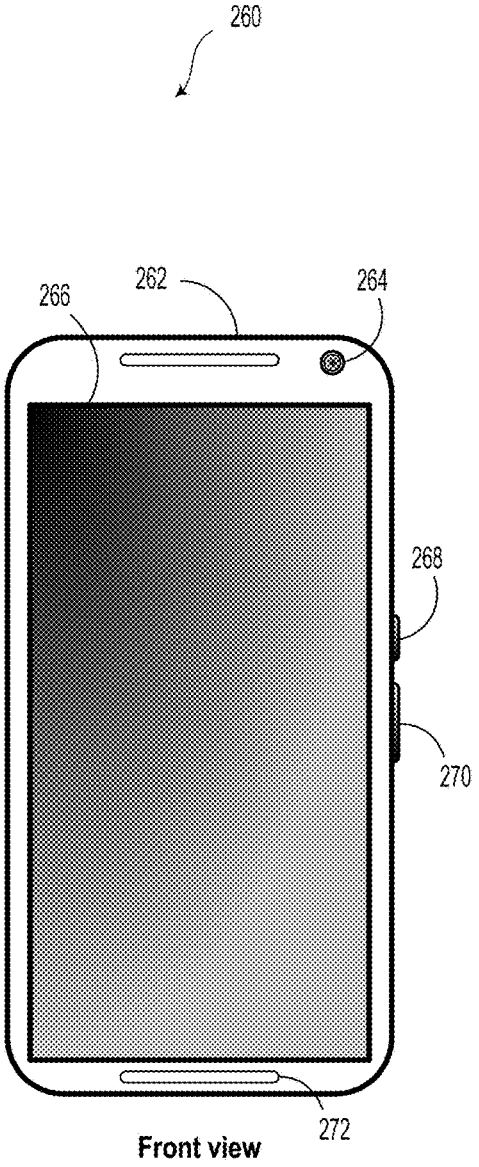
FIG. 2D illustrates a computing device, according to example embodiments.

FIG. 2D illustrates a computing device 260, according to an example embodiment. The computing device 260 may be, for example, a mobile phone, a smartphone, a tablet computer, or a wearable computing device. However, other embodiments are possible. In an example embodiment, computing device 260 may include some or all of the elements of system 100 as illustrated and described in relation to FIG. 1.

Computing device 260 may include various elements, such as a body 262, a camera 264, a multi-element display 266, a first button 268, a second button 270, and a microphone 272. The camera 264 may be positioned on a side of body 262 typically facing a user while in operation, or on the same side as multi-element display 266. Other arrangements of the various elements of computing device 260 are possible.

The microphone 272 may be operable to detect audio signals from an environment near the computing device 260. For example, microphone 272 may be operable to detect voices and/or whether a user of computing device 260 is in a conversation with another party.

Multi-element display 266 could represent a LED display, an LCD, a plasma display, or any other type of visual or graphic display. Multi-element display 266 may also support touchscreen and/or presence-sensitive functions that may be able to adjust the settings and/or configuration of any aspect of computing device 260.

In an example embodiment, computing device 260 may be operable to display information indicative of various aspects of audio signals being provided to a user. For example, the computing device 260 may display, via the multi-element display 266, a current audio playback configuration. The current audio playback configuration may include a graphical representation of the user's acoustic soundstage. The graphical representation may depict, for instance, an apparent source location of various audio sources. The graphical representations may be similar, at least in part, to those illustrated and described in relation to FIGS. 3A-3D, however other graphical representations are possible and contemplated herein.

While FIGS. 3A-3D illustrate a particular order and arrangement of the various operations described herein, it is understood that the specific timing sequences and exposure durations may vary. Furthermore, some operations may be omitted, added, and/or performed in parallel with other operations.

Figure 3A:
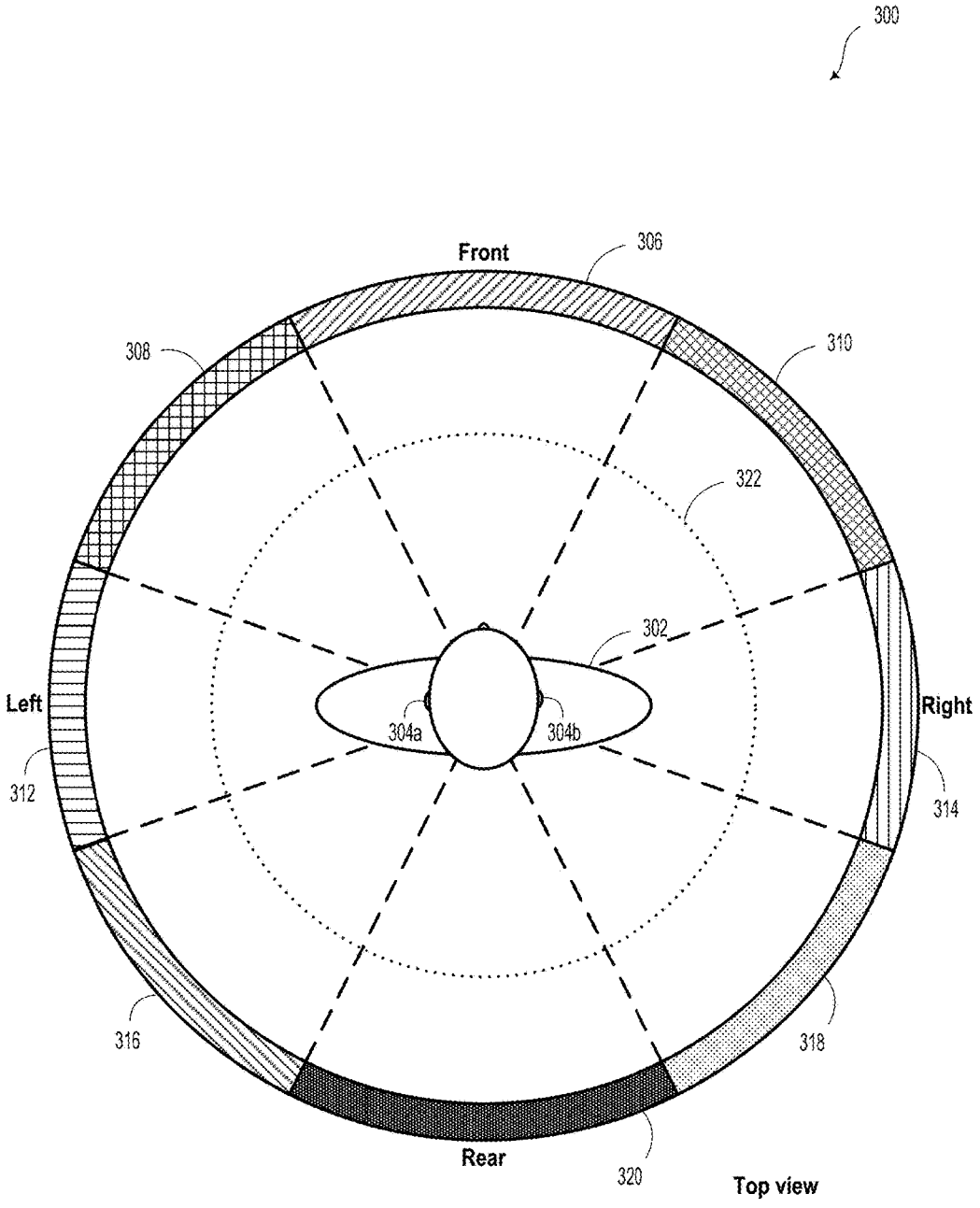
FIG. 3A illustrates an acoustic soundstage, according to an example embodiment.

FIG. 3A illustrates an acoustic soundstage 300 from a top view above a listener 302, according to an example embodiment. In an example embodiment, the acoustic soundstage 300 may represent a set of zones around a listener 302. Namely, the acoustic soundstage 300 may include a plurality of spatial zones within which the listener 302 may localize sound. That is, an apparent source location of sound heard via ears 304*a* and 304*b* (and/or vibrations via bone-conduction systems) may be perceived as being within the acoustic soundstage 300.

The acoustic soundstage 300 may include a plurality of spatial wedges that include a front central zone 306, a front left zone 308, a front right zone 310, a left zone 312, a right zone 314, a left rear zone 316, a right rear zone 318, and a rear zone 320. The respective zones may extend away from the listener 302 in a radial manner. Additionally or alternatively, other zones are possible. For example, the radial zones may additionally or alternatively include regions proximate and distal to the listener 302. For example, an apparent source location of an audio signal could be near to a person (e.g., inside circle 322). Additionally or alternatively, an apparent source location of the audio signal may be more distant from the person (e.g., outside circle 322).

Figure 3B:
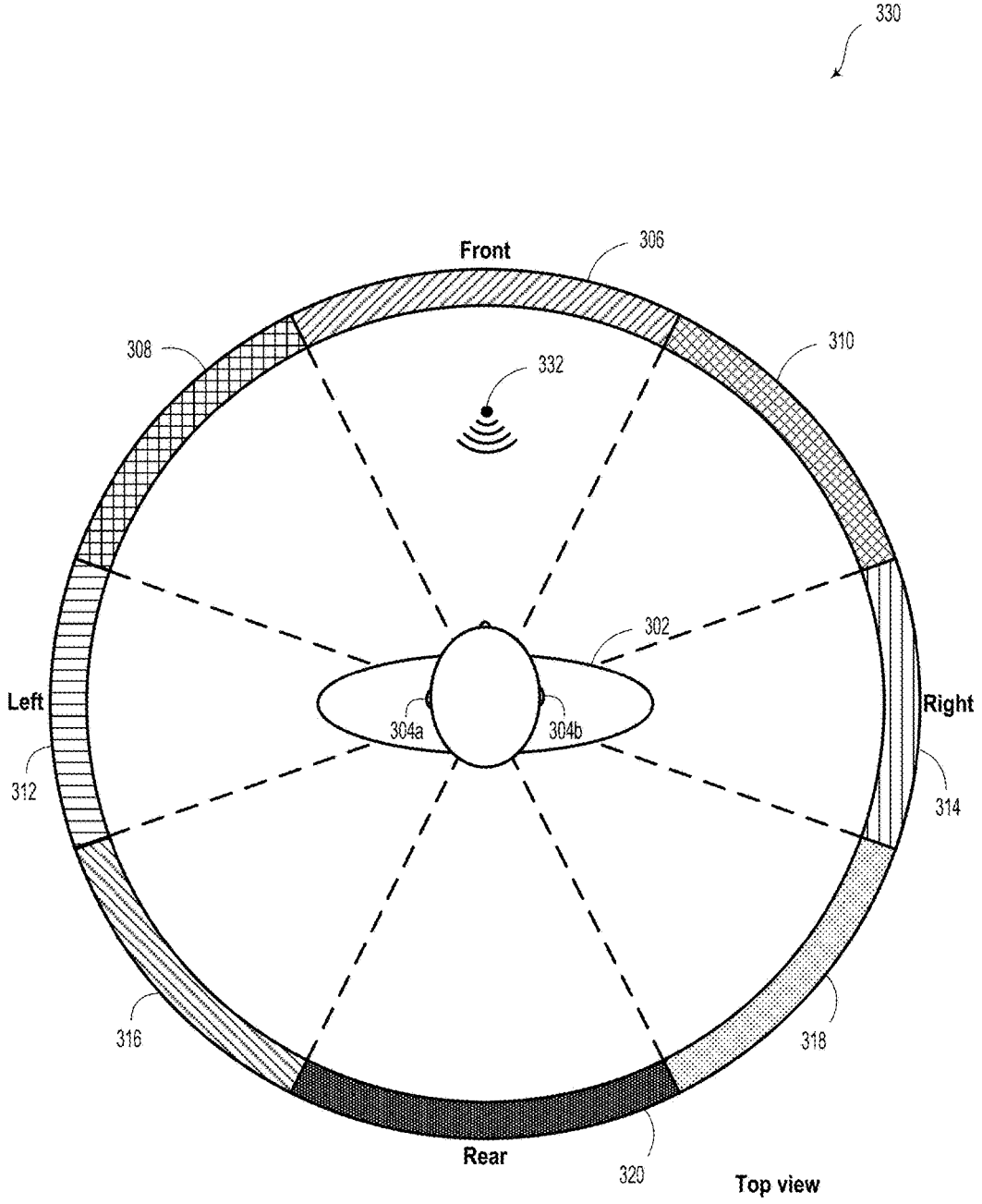
FIG. 3B illustrates a listening scenario, according to an example embodiment.

FIG. 3B illustrates a listening scenario 330, according to an example embodiment. In listening scenario 330, a computing device, which may be similar or identical to computing device 100, may provide a listener 302 with a first audio signal. The first audio signal may include music or another type of audio signal. The computing device may adjust ILD and/or ITD of the first audio signal to control its apparent source location. Specifically, the computing device may control ILD and/or ITD according to an Ambisonics algorithm or a head-related transfer function (HRTF) such that the apparent source location 332 of the first audio signal is within a front zone 306 of the acoustic soundstage 300.

Figure 3C:
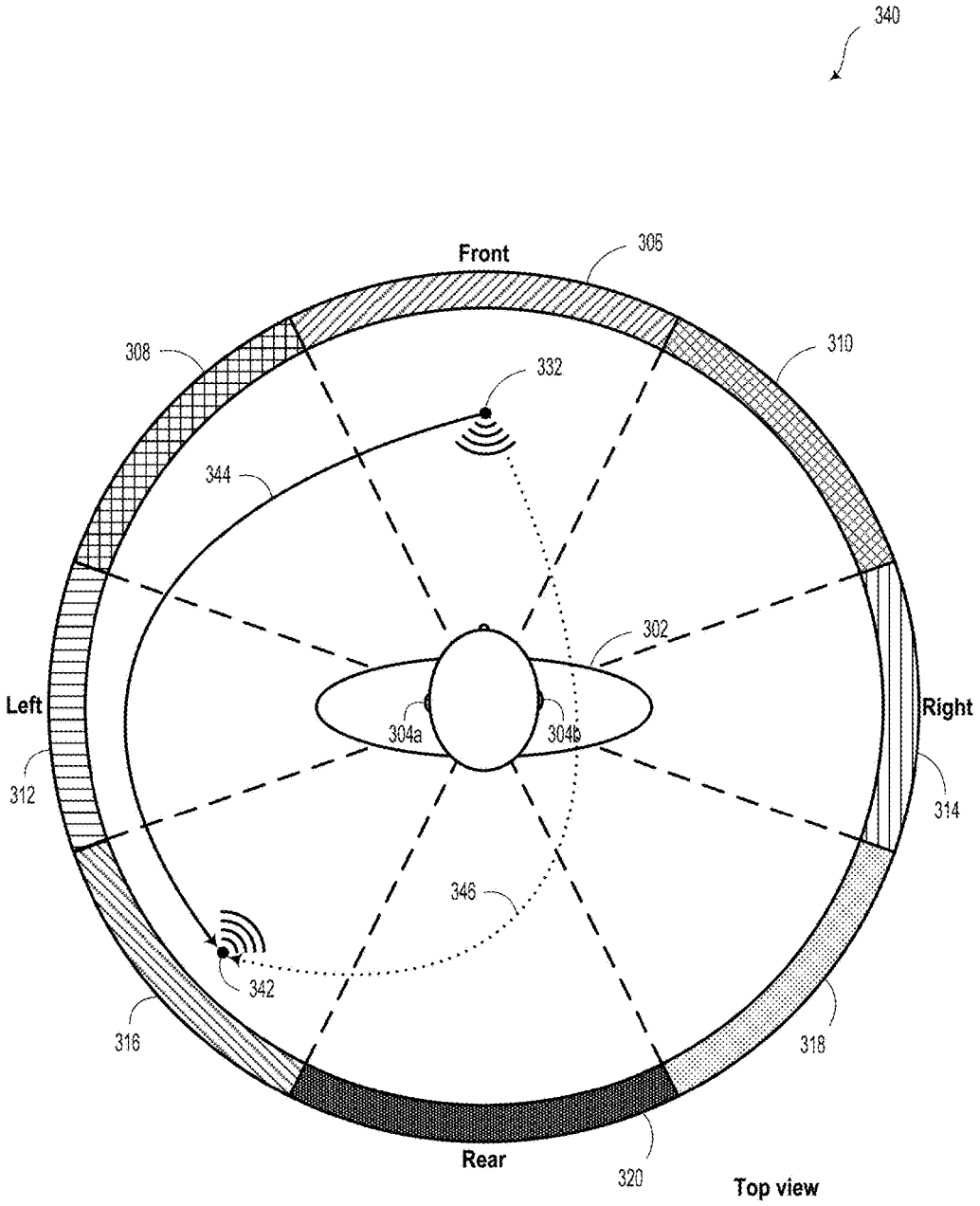
FIG. 3C illustrates a listening scenario, according to an example embodiment.

FIG. 3C illustrates a listening scenario 340, according to an example embodiment. Listening scenario 340 may include receiving a notification associated with a second audio signal. For example, the received notification may include an e-mail, a text, a voicemail, or a call. Other types of notifications are possible. Based on an attribute of the notification, a high priority notification may be determined. That is, the notification may be determined to have a higher priority than playout of the first audio signal. In such a scenario, the apparent source location of the first audio signal may be moved within the acoustic soundstage from a front zone 306 to a left rear zone 316. That is, initially, the first audio signal may be driven via the computing device such that a user may perceive an apparent source location 332 as being in the front zone 306. After determining a high priority notification condition, the first audio signal may be moved (progressively or instantaneously) to an apparent source location 342, which may be in the left rear zone 316. The first audio signal may be moved to another zone within the acoustic soundstage.

Note that the first audio signal may be moved to a different apparent distance away from the listener 302. That is, initial apparent source location 332 may be at a first distance from the listener 302 and final apparent source location 342 may be at a second distance from the listener 302. In an example embodiment, the final apparent source location 342 may be further away from the listener 302 than the initial apparent source location 332.

Additionally or alternatively, the apparent source location of the first audio signal may be moved along a path 344 such that the first audio signal may be perceived to move progressively to the listener's left and rear. Alternatively, other paths are possible. For example, the apparent source location of the first audio signal may move along a path 346, which may be perceived by the listener as the first audio signal passing over his or her right shoulder.

Figure 3D:
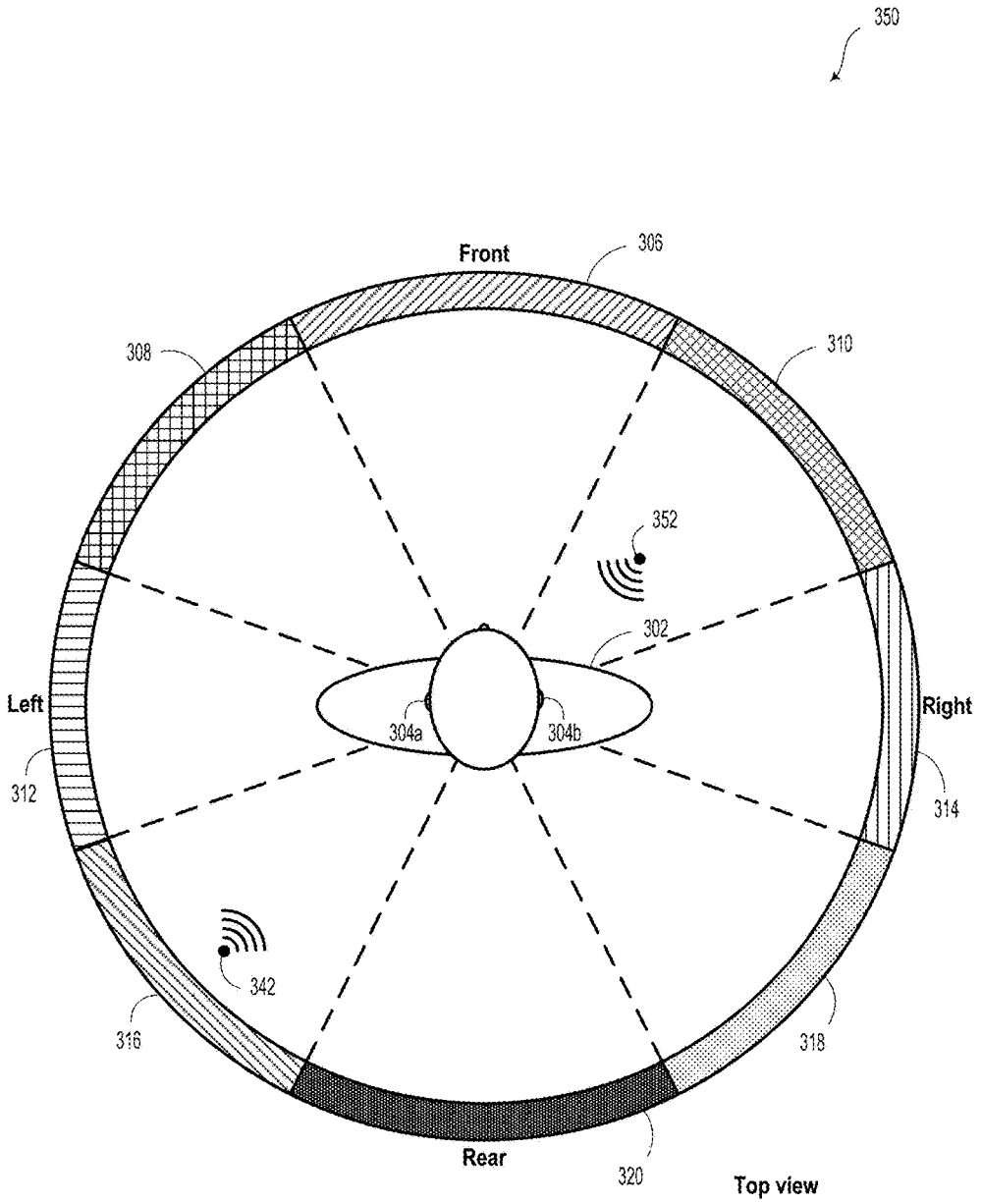
FIG. 3D illustrates a listening scenario, according to an example embodiment.

FIG. 3D illustrates a listening scenario 350, according to an example embodiment. Listening scenario 350 may occur upon determining that the notification has a higher priority than playout of the first audio signal, or at a later time. Namely, while the apparent source location of the first audio signal is moving, or after it has moved to final apparent source location 342, a second audio signal may be played by the computing device. The second audio signal may be played at an apparent source location 352 (e.g., in the front right zone 310). As illustrated in FIG. 3D, some high priority notifications may have an apparent source location near to the listener 302. Alternatively, the apparent source location may be at other distances with respect to the listener 302. The apparent source location 352 of the second audio signal may be static (e.g., all high priority notifications played by default in the front right zone 310), or the apparent source location may vary based on, for example, a notification type. For example, high priority email notifications may have an apparent source location in the front right zone 310 while high priority text notifications may have an apparent source location in the front left zone 308. Other locations are possible based on the notification type. The apparent source location of the second audio source may vary based on other aspects of the notification.

III. Example Methods

Figure 4A:
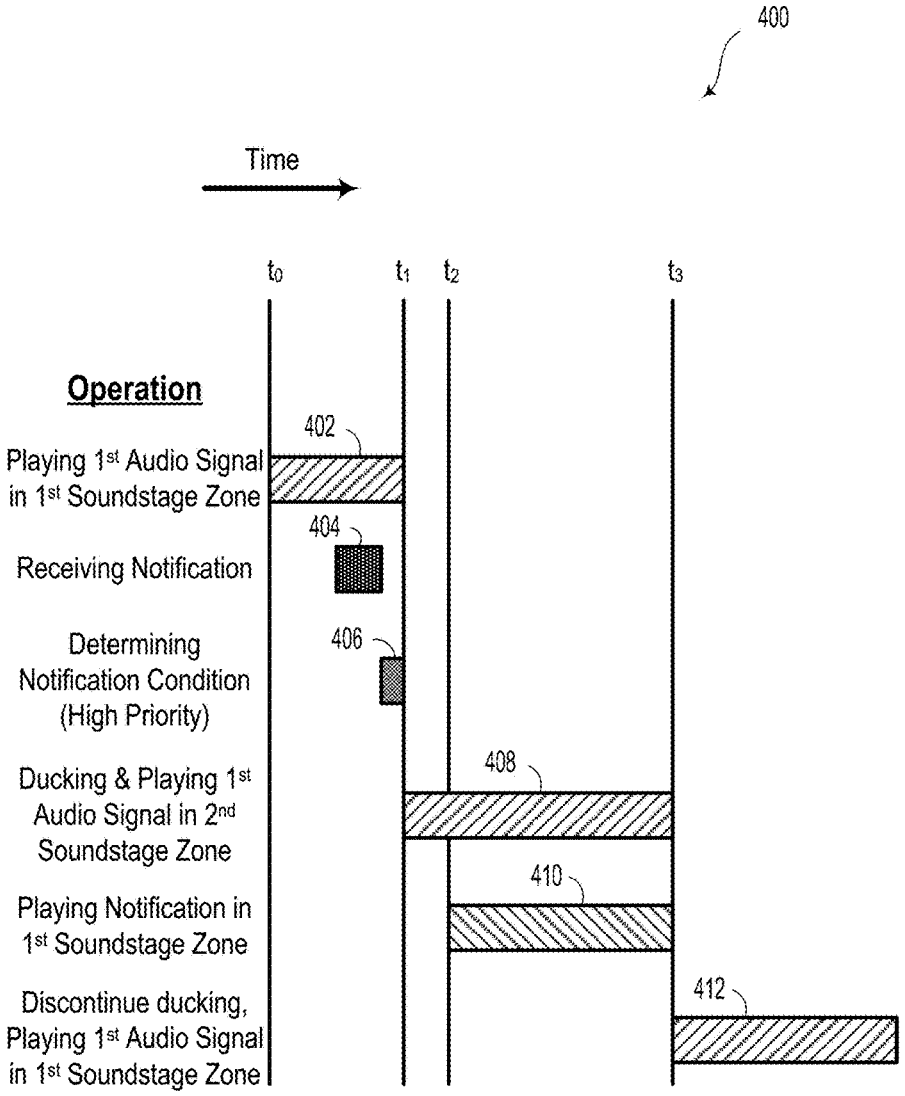
FIG. 4A illustrates an operational timeline, according to an example embodiment.

FIG. 4A illustrates an operational timeline 400, according to an example embodiment. Operational timeline 400 may describe events similar or identical to those illustrated and described in reference to FIGS. 3A-3D as well as method steps or blocks illustrated and described in reference to FIG. 5. While FIG. 4A illustrates a certain sequence of events, it is understood that other sequences are possible. In an example embodiment, a computing device, such as computing device 100, may play a first audio signal at time $t_0$ in a first acoustic soundstage zone, as illustrated in block 402. That is, a controller of the computing device, such as controller 150 as illustrated and described with regard to FIG. 1, may spatially process the first audio signal such that it is perceivable in the first acoustic soundstage zone. In some embodiments, the first audio signal need not be spatially processed and the first audio signal may be played back without specific spatial queues. Block 404 illustrates receiving a notification. As described herein, the notification may include a text message, a voice mail, an email, a video call invitation, etc. The notification may include metadata or other information that may be indicative of a priority level. As illustrated in block 406, the computing device may determine a notification as being high priority with respect to the playout of the first audio signal based on the metadata, an operational status of the computing device, and/or other factors.

As illustrated by block 408, upon determining a high priority notification, the controller may spatially duck the first audio signal starting at time $t_1$, by moving its apparent source location from a first acoustic soundstage zone to a second acoustic soundstage zone. That is, the controller may spatially process the first audio signal such that its perceivable source location moves from an initial acoustic soundstage zone (e.g., the first acoustic soundstage zone) to a final acoustic soundstage zone (e.g., the second acoustic soundstage zone).

While the apparent source location of the first audio signal is moving, or after it has reached the second acoustic soundstage zone, the second audio signal associated with the controller may spatially process the notification such that it is perceivable with an apparent source location in the first acoustic soundstage zone at time $t_2$ as illustrated by block 410.

Block 412 illustrates that the computing device may discontinue spatial ducking of the first audio signal upon playing the notification in the first acoustic soundstage zone at $t_3$. In an example embodiment, discontinuation of the spatial ducking may include moving the apparent source location of the first audio signal back to the first acoustic soundstage zone.

Figure 4B:
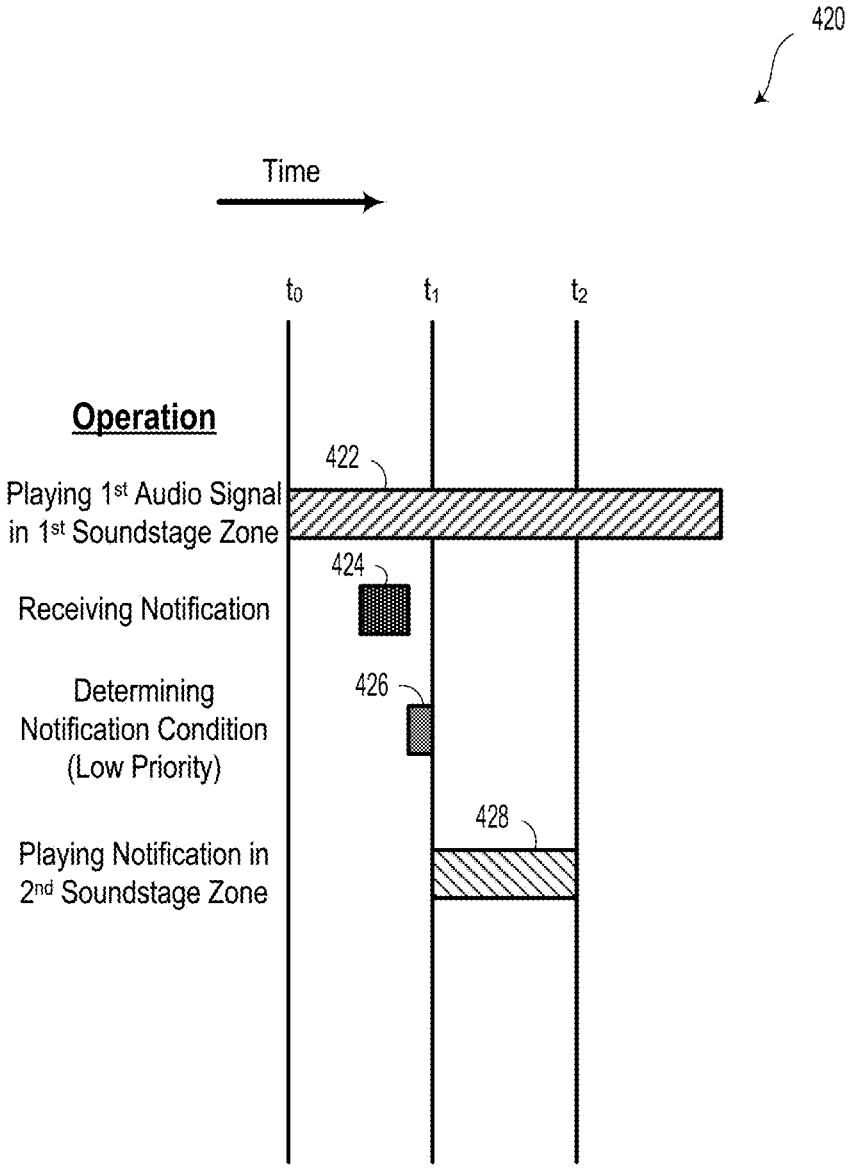
FIG. 4B illustrates an operational timeline, according to an example embodiment.

FIG. 4B illustrates an operational timeline 420, according to an example embodiment. At time $t_0$, the computing device may play a first audio signal (e.g., music), as illustrated in block 422. As illustrated in block 424, the computing device may receive a notification. As described elsewhere herein, the notification may be one of any number of different notification types (e.g., incoming email message, incoming voicemail, etc.).

As illustrated in block 426, based on at least one aspect of the notification, the computing device may determine that the notification is low priority. In an example embodiment, the low priority notification may be determined based on a preexisting contact list and/or metadata. For example, the notification may relate to a text message from an unknown contact or an email message sent with "low importance." In such scenarios, the computing device (e.g., the controller 150) may determine the low priority notification condition based on the respective contextual situations.

As illustrated in block 428, in response to determining the low priority notification at time $t_1$, a second audio signal associated with the notification may be played in the second acoustic soundstage zone. In other embodiments, a second audio signal associated with a low priority notification need not be played, or may be delayed until a later time (e.g., after a higher priority activity is complete).

Figure 5:
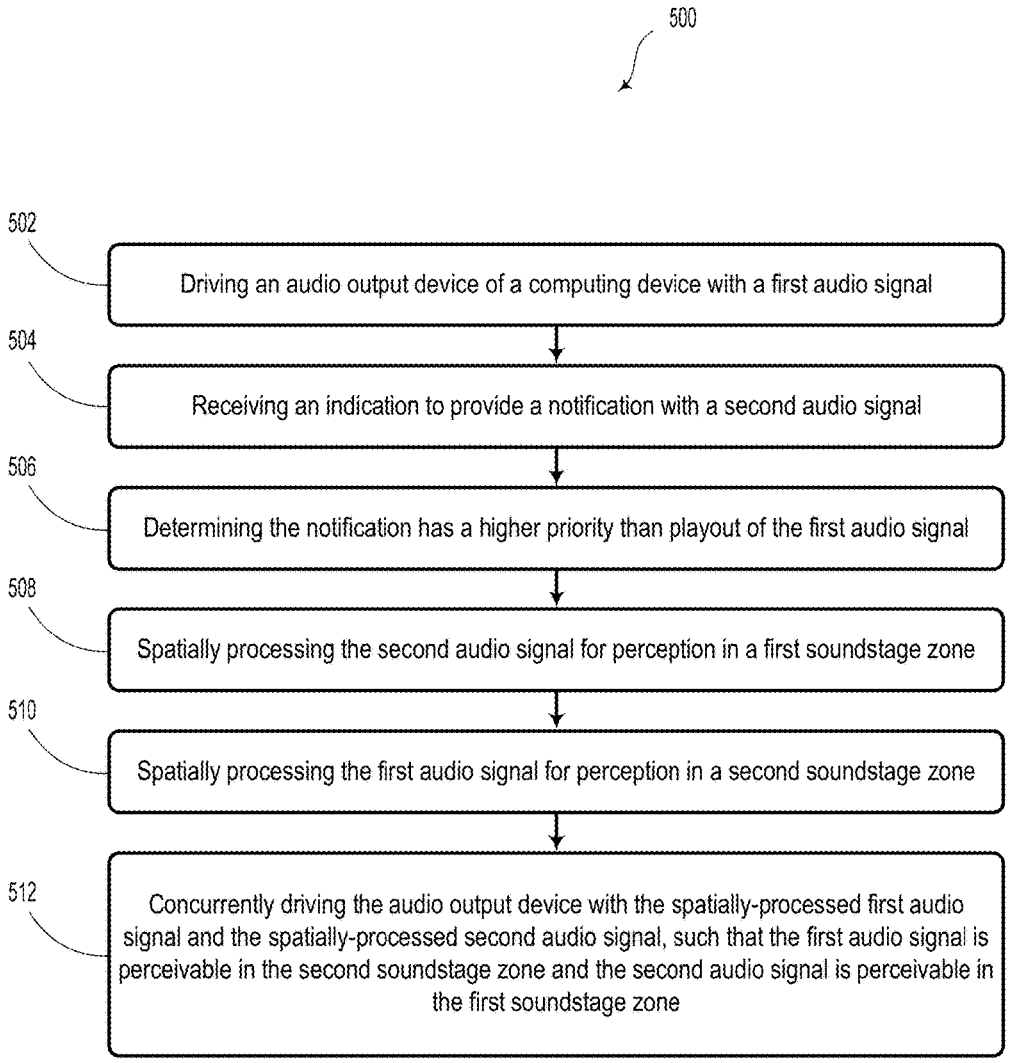
FIG. 5 illustrates a method, according to an example embodiment.

FIG. 5 illustrates a method 500, according to an example embodiment. The method 500 may include various blocks or steps. The blocks or steps may be carried out individually or in combination. The blocks or steps may be carried out in any order and/or in series or in parallel. Further, blocks or steps may be omitted or added to method 500.

Some or all blocks of method 500 may involve elements of devices 100, 200, 230, 250, and/or 260 as illustrated and described in reference to FIGS. 1, 2A-2D. For example, some or all blocks of method 500 may be carried out by controller 150 and/or processor 152 and memory 154. Furthermore, some or all blocks of method 500 may be similar or identical to operations illustrated and described in relation to FIGS. 4A and 4B.

Block 502 includes driving an audio output device of a computing device, such as computing device 100, with a first audio signal. In some embodiments, driving the audio output device with the first audio signal may include a controller, such as controller 150, adjusting ILD and/or ITD of the first audio signal according to an Ambisonics algorithm or an HRTF. For example, the controller may adjust ILD and/or ITD so as to spatially process the first audio signal such that it is perceivable as originating in a first acoustic soundstage zone. In other example embodiments, the first audio signal may be played initially without need for such spatial processing.

Block 504 includes receiving an indication to provide a notification with a second audio signal.

Block 506 includes determining the notification has a higher priority than playout of the first audio signal. For example, a controller of the computing device may determine a notification to have the higher priority with respect to the playout of the first audio signal.

Block 508 includes, in response to determining a higher priority notification, spatially processing the second audio signal for perception in a first soundstage zone. In such a scenario, the first audio signal may be spatially processed by the controller so as to be perceivable in a second acoustic soundstage zone. As described elsewhere herein, spatial processing of the first audio signal may include attenuation of a volume of the first audio signal or increasing an apparent source distance of the first audio signal with respect to a user of the computing device.

Block 510 includes spatially processing the first audio signal for perception in a second soundstage zone.

Block 512 includes concurrently driving the audio output device with the spatially-processed first audio signal and the spatially-processed second audio signal, such that the first audio signal is perceivable in the second soundstage zone and the second audio signal is perceivable in the first soundstage zone.

In some embodiments, the method may optionally include detecting, via at least one sensor of the computing device, a contextual indication of a user activity (e.g., sleeping, walking, talking, exercising, driving, etc.). For example, the contextual indication may be determined based on an analysis of motion/acceleration from one or more IMUS. In an alternative embodiment, the contextual indication may be determined based on an analysis of an ambient sound/frequency spectrum. In some embodiments, the contextual indication may be determined based on a location of the computing device (e.g., via GPS information). Yet further embodiments may include an application program interface (API) call to another device or system configured to provide an indication of the present context. In such scenarios, determining the notification priority may be further based on the detected contextual indication of the user activity.

Figure 6:
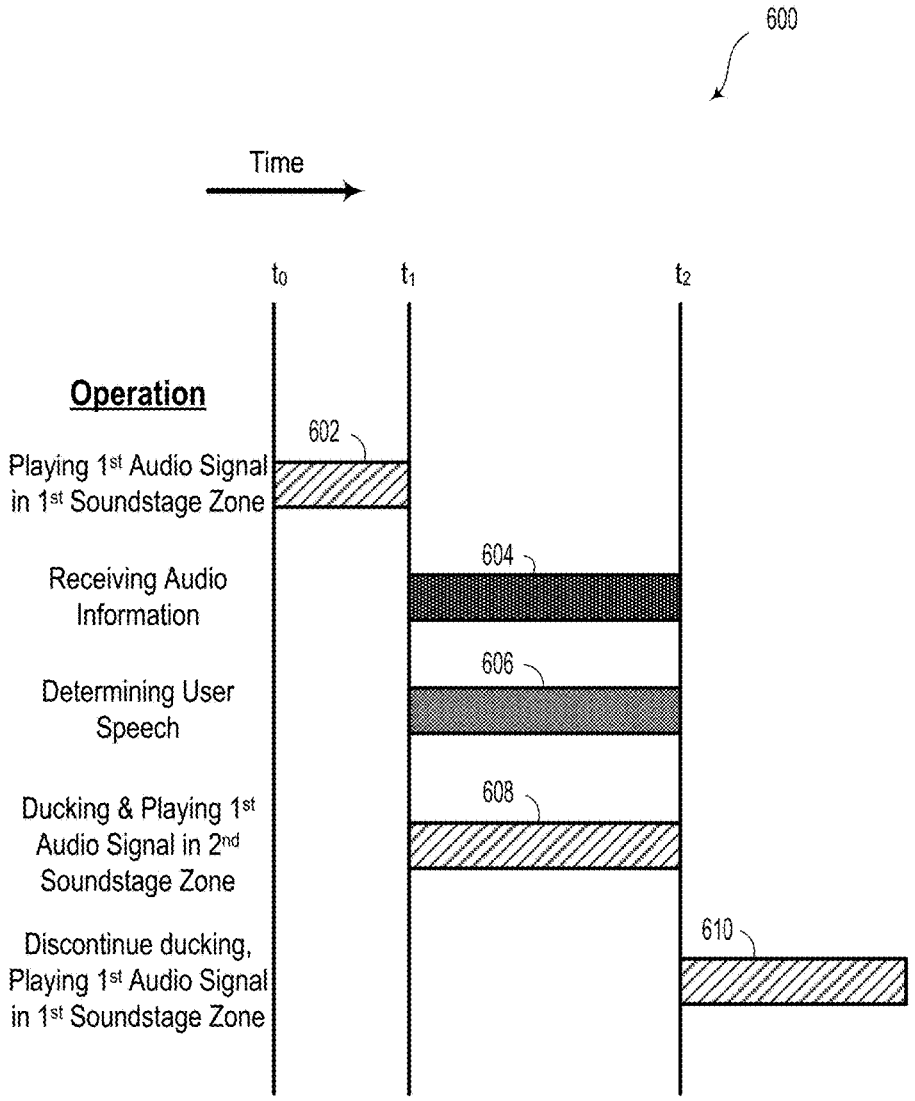
FIG. 6 illustrates an operational timeline, according to an example embodiment.

FIG. 6 illustrates an operational timeline 600, according to an example embodiment. Block 602 includes, at time $t_0$, playing (via a computing device) a first audio signal with an apparent source location within a first acoustic soundstage zone. Block 604 includes, at time $t_1$, receiving audio information. In an example embodiment, the audio information may include information indicative of speech. Particularly, the audio information may indicate speech by a user of the computing device. For example, the user may be in a conversation with another person, or may be humming, singing, or otherwise making vocal noises.

In such scenarios, block 606 includes the computing device determining user speech based on the received audio information.

Upon determining user speech, as illustrated in block 608, the first audio signal may be spatially ducked by moving its apparent source location to a second acoustic soundstage zone. Additionally or alternatively, the first audio signal may be attenuated or may be moved to a source location apparently farther away from the user of the computing device.

As illustrated in block 610, at time $t_2$ (once user speech is no longer detected), the computing device may discontinue spatial ducking of the first audio signal. As such, the apparent source location of the first audio signal may be moved back to the first acoustic soundstage zone, and/or its original volume restored.

Figure 7:
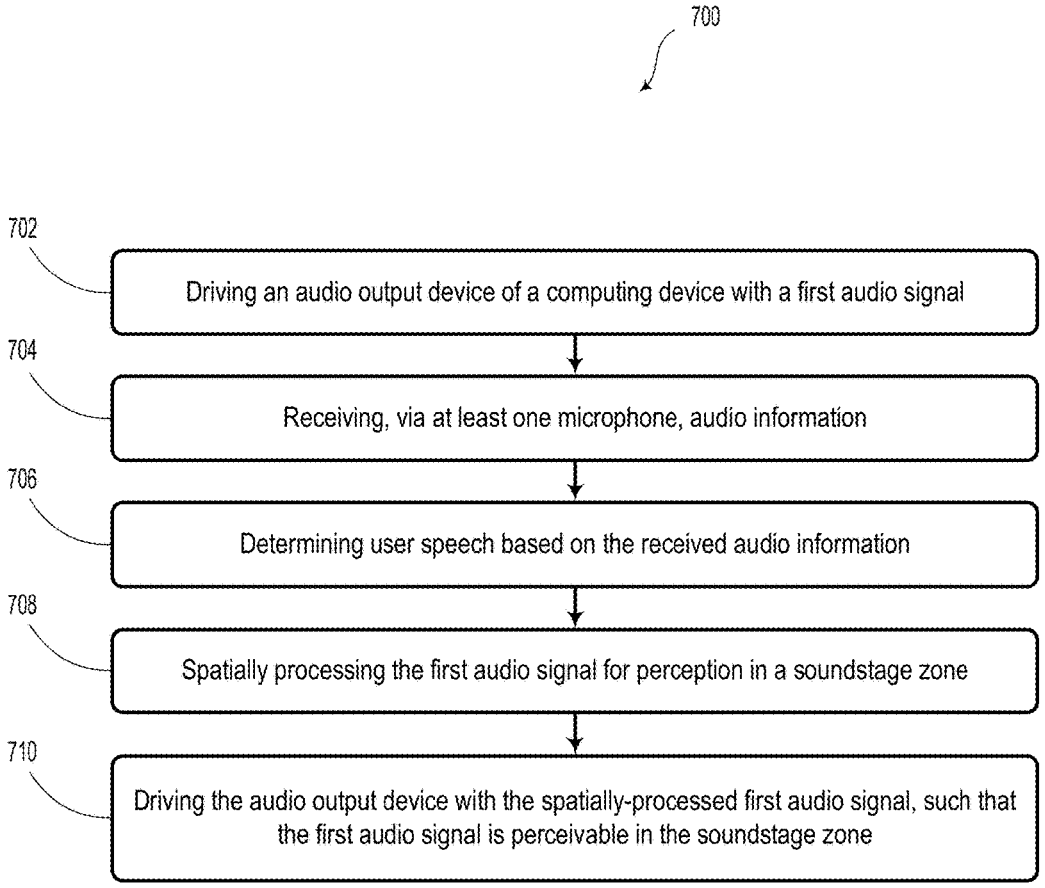
FIG. 7 illustrates a method, according to an example embodiment.

FIG. 7 illustrates a method 700, according to an example embodiment. The method 700 may include various blocks or steps. The blocks or steps may be carried out individually or in combination. The blocks or steps may be carried out in any order and/or in series or in parallel. Further, blocks or steps may be omitted or added to method 700.

Some or all blocks of method 700 may involve elements of computing device 100, wearable devices 200, 230, or 250, and/or computing device 260 as illustrated and described in reference to FIGS. 1, 2A-2D. For example, some or all blocks of method 700 may be carried out by controller 150 and/or processor 152 and memory 154. Furthermore, some or all blocks of method 700 may be similar or identical to operations illustrated and described in relation to FIG. 6.

Block 702 includes driving an audio output device of a computing device, such as computing device 100, with a first audio signal. In some embodiments, the controller 150 may spatially process the first audio signal such that it is perceivable in a first acoustic soundstage zone. However, in other embodiments, the first audio signal need not be spatially processed initially.

Block 704 includes receiving, via at least one microphone, audio information. In some embodiments, the at least one microphone may include a microphone array. In such scenarios, the method may optionally include directing, by the microphone array, a listening beam toward a user of the computing device.

Block 706 includes determining user speech based on the received audio information. For example, determining user speech may include determining that a signal-to-noise ratio of the audio information is above a predetermined threshold ratio (e.g., greater than a predetermined signal to noise ratio). Other ways to determine user speech are possible. For example, the audio information may be processed with a speech recognition algorithm (e.g., by the computing device 100). In some embodiments, the speech recognition algorithms may be configured to determined user speech from a plurality of speech sources in the received audio information. That is, the speech recognition algorithm may be configured to distinguish between speech from the user of the computing device and other speaking individuals and/or audio sources within a local environment around the computing device.

Block 708 includes, in response to determining user speech, spatially processing the first audio signal for perception in a soundstage zone. Spatially processing the first audio signal includes adjusting ILT and/or ILD or other attributes of the first audio signal such that the first audio signal is perceivable in a second acoustic soundstage zone. Spatial processing of the first audio signal may additionally include attenuating a volume of the first audio signal or increasing an apparent source distance of the first audio signal.

Spatial processing of the first audio signal may include a spatial transition of the first audio signal. For instance, the spatial transition may include spatially processing the first audio signal so as to move an apparent source position of the first audio signal from the first acoustic soundstage zone to the second acoustic soundstage zone. In some embodiments, an apparent source position of a given audio signal may be moved through a plurality of acoustic soundstage zones. Furthermore, the spatial processing of the first audio signal may be discontinued after a predetermined length of time has elapsed.

Block 710 includes driving the audio output device with the spatially-processed first audio signal, such that the first audio signal is perceivable in the soundstage zone.

The particular arrangements shown in the Figures should not be viewed as limiting. It should be understood that other embodiments may include more or less of each element shown in a given Figure. Further, some of the illustrated elements may be combined or omitted. Yet further, an illustrative embodiment may include elements that are not illustrated in the Figures.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical functions or actions in the method or technique. The program code and/or related data can be stored on any type of computer readable medium such as a storage device including a disk, hard drive, or other storage medium.

The computer readable medium can also include non-transitory computer readable media such as computer-readable media that store data for short periods of time like register memory, processor cache, and random access memory (RAM). The computer readable media can also include non-transitory computer readable media that store program code and/or data for longer periods of time. Thus, the computer readable media may include secondary or persistent long term storage, like read only memory (ROM), optical or magnetic disks, compact-disc read only memory (CD-ROM), for example. The computer readable media can also be any other volatile or non-volatile storage systems. A computer readable medium can be considered a computer readable storage medium, for example, or a tangible storage device.

While various examples and embodiments have been disclosed, other examples and embodiments will be apparent to those skilled in the art. The various disclosed examples and embodiments are for purposes of illustration and are not intended to be limiting, with the true scope being indicated by the following claims.

What is claimed is:

1. A computing device comprising:

an audio output device;

a processor;

a non-transitory computer readable medium; and program instructions stored on the non-transitory computer readable medium that, when executed by the processor, cause the computing device to perform operations, the operations comprising, while driving the audio output device with a first audio signal:

receiving an indication to provide a notification with a second audio signal;

determining the notification has a higher priority than playout of the first audio signal; and in response to determining that the notification has the higher priority:

spatially processing the second audio signal such that the second audio signal is perceivable as originating in a first soundstage zone;

spatially processing the first audio signal such that the first audio signal is perceivable as originating in a second soundstage zone; and concurrently driving the audio output device with the spatially-processed first audio signal and the spatially-processed second audio signal, such that the first audio signal is perceivable in the second soundstage zone and the second audio signal is perceivable in the first soundstage zone.

2. The computing device of claim 1, wherein spatially processing the first audio signal comprises attenuating a volume of the first audio signal or increasing an apparent distance of a source of the first audio signal.

3. The computing device of claim 2, wherein the first audio signal is spatially-processed such that the first audio signal is perceivable as originating in the second soundstage zone for a predetermined length of time, wherein the operations further comprise, responsive to the predetermined length of time elapsing, discontinuing the spatial processing of the first audio signal for perception in the second soundstage zone.

4. The computing device of claim 1, further comprising at least one bone conduction transducer device communicatively coupled to the audio output device, wherein the first audio signal is perceivable as originating in the second soundstage zone and the second audio signal is perceivable as originating in the first soundstage zone via the at least one bone conduction transducer device.

5. The computing device of claim 1, wherein, before determining that playout of the second audio signal has the higher priority, the first audio signal is spatially processed such that the first audio signal is perceivable as originating in the first soundstage zone, such that the subsequent spatial processing of the first audio signal such that the first audio signal is perceivable as originating in the second soundstage zone moves an apparent position of a source of the first audio signal from the first soundstage zone to the second soundstage zone.

6. The computing device of claim 1, wherein the first audio signal is initially spatially processed such that the first audio signal is perceivable as originating in the first soundstage zone, and wherein spatially processing the first audio signal for perception in the second soundstage zone in response to determining that the notification has the higher priority comprises adjusting interaural level differences and interaural time differences of the first audio signal according to an Ambisonics algorithm or a head-related transfer function such that the first audio signal is perceivable as originating in the second soundstage zone.

7. The computing device of claim 1, wherein the operations further comprise:

detecting, via at least one sensor of the computing device, a contextual indication of a user activity, wherein determining the notification has a higher priority than playout of the first audio signal is based on the detected contextual indication of the user activity.

8. The computing device of claim 1, wherein spatially processing the second audio signal such that the second audio signal is perceivable as originating in the first soundstage zone comprises spatially processing the second audio signal such that the second audio signal is perceivable as originating in front of a listener of the computing device and wherein spatially processing the first audio signal such that the first audio signal is perceivable as originating in the first soundstage zone comprises spatially processing the first audio signal such that the first audio signal is perceivable as originating behind the listener of the computing device.

9. A method comprising:

driving an audio output device of a computing device with a first audio signal;

receiving an indication to provide a notification with a second audio signal;

determining the notification has a higher priority than playout of the first audio signal; and in response to determining that the notification has the higher priority:

spatially processing the second audio signal such that the second audio signal is perceivable as originating in a first soundstage zone;

spatially processing the first audio signal such that the first audio signal is perceivable as originating in a second soundstage zone; and concurrently driving the audio output device with the spatially-processed first audio signal and the spatially-processed second audio signal, such that the first audio signal is perceivable in the second soundstage zone and the second audio signal is perceivable in the first soundstage zone.

10. The method of claim 9, wherein spatially processing the first audio signal comprises attenuating a volume of the first audio signal or increasing an apparent distance of a source of the first audio signal.

11. The method of claim 10, wherein the first audio signal is spatially-processed such that the first audio signal is perceivable as originating in the second soundstage zone for a predetermined length of time, wherein the method further comprises, responsive to the predetermined length of time elapsing, discontinuing the spatial processing of the first audio signal such that the first audio signal is perceivable as originating in the second soundstage zone.

12. The method of claim 9, wherein the audio output device is communicatively coupled to at least one bone conduction transducer device, wherein the first audio signal is perceivable as originating in the second soundstage zone and the second audio signal is perceivable as originating in the first soundstage zone via the at least one bone conduction transducer device.

13. The method of claim 9, wherein the first audio signal is initially spatially processed such that the first audio signal is perceivable as originating in the first soundstage zone, and wherein spatially processing the first audio signal for perception in the second soundstage zone in response to determining that the notification has the higher priority comprises adjusting interaural level differences and interaural time differences of the first audio signal according to an Ambisonics algorithm or a head-related transfer function such that the first audio signal is perceivable as originating in the second soundstage zone.

14. The method of claim 9, wherein the operations further comprise:

detecting, via at least one sensor, a contextual indication of a user activity, wherein determining the notification has a higher priority than playout of the first audio signal is based on the detected contextual indication of the user activity.

* * * * *